US009607742B2

(12) United States Patent
Ishiyama et al.

(10) Patent No.: US 9,607,742 B2
(45) **Date of Patent: *Mar. 28, 2017**

(54) R-T-B BASED ALLOY STRIP, AND R-T-B BASED SINTERED MAGNET AND METHOD FOR PRODUCING SAME

(71) Applicant: TDK CORPORATION, Tokyo (JP)

(72) Inventors: Tamotsu Ishiyama, Tokyo (JP); Taeko Tsubokura, Tokyo (JP); Eiji Kato, Tokyo (JP); Nobuhiro Jingu, Tokyo (JP); Chikara Ishizaka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 419 days.

This patent is subject to a terminal disclaimer.

(21) Appl. No.: 14/351,119

(22) PCT Filed: Oct. 11, 2012

(86) PCT No.: PCT/JP2012/076324

§ 371 (c)(1),
(2) Date: Apr. 10, 2014

(87) PCT Pub. No.: WO2013/054845

PCT Pub. Date: Apr. 18, 2013

(65) Prior Publication Data

US 2014/0286815 A1 Sep. 25, 2014

(30) Foreign Application Priority Data

Oct. 13, 2011 (JP) ..... 2011-226040
Oct. 13, 2011 (JP) ..... 2011-226042
(Continued)

(51) Int. Cl.
*C22C 33/02* (2006.01)
*C22C 38/10* (2006.01)
(Continued)

(52) U.S. Cl.
CPC ..... *H01F 1/053* (2013.01); *B22D 11/0611* (2013.01); *C22C 38/002* (2013.01);
(Continued)

(58) Field of Classification Search
CPC ... B22D 11/0611; H01F 1/053; H01F 1/0536; H01F 1/0571; H01F 1/0577;
(Continued)

(56) References Cited

U.S. PATENT DOCUMENTS 5,431,747 A * 7/1995 Takebuchi ..... C22C 33/02 420/83
7,311,788 B2 * 12/2007 Nishizawa ..... C22C 38/002 148/302
(Continued)

FOREIGN PATENT DOCUMENTS

CN 1442253 A 9/2003
CN 1942264 A 4/2007
(Continued)

OTHER PUBLICATIONS

Apr. 15, 2014 International Preliminary Report on Patentability issued in International Application No. PCT/JP2012/076327.
(Continued)

*Primary Examiner* — Helene Klemanski
(74) *Attorney, Agent, or Firm* — Oliff PLC

(57) ABSTRACT

An R-T-B based alloy strip containing dendritic crystals including a $R_2T_{14}B$ phase, wherein on at least one surface, the average value for the widths of the dendritic crystals is no greater than 60 μm, and the number of crystal nuclei in the dendritic crystals is at least 500 per 1 mm square area.

5 Claims, 18 Drawing Sheets

(30) Foreign Application Priority Data

Nov. 14, 2011 (JP) ..... 2011-248978
Nov. 14, 2011 (JP) ..... 2011-248980

(51) Int. Cl.

| | |
|---|---|
| ***B22D 11/06*** | (2006.01) |
| ***H01F 1/053*** | (2006.01) |
| ***H01F 1/057*** | (2006.01) |
| ***H01F 1/08*** | (2006.01) |
| ***H01F 41/02*** | (2006.01) |
| ***C22C 38/00*** | (2006.01) |
| ***C22C 38/06*** | (2006.01) |
| ***C22C 38/14*** | (2006.01) |
| ***C22C 38/16*** | (2006.01) |

(52) U.S. Cl.
CPC ..... *C22C 38/005* (2013.01); *C22C 38/06* (2013.01); *C22C 38/10* (2013.01); *C22C 38/14* (2013.01); *C22C 38/16* (2013.01); *H01F 1/0536* (2013.01); *H01F 1/0571* (2013.01); *H01F 1/086* (2013.01); *H01F 41/0266* (2013.01); *C22C 33/02* (2013.01); *C22C 2202/02* (2013.01); *H01F 1/0577* (2013.01)

(58) Field of Classification Search
CPC ..... H01F 1/086; H01F 41/0266; C22C 33/02; C22C 38/002; C22C 38/005; C22C 38/10; C22C 2202/02
USPC ..... 148/101; 419/33; 420/83; 75/246
See application file for complete search history.

(56) References Cited

U.S. PATENT DOCUMENTS

| | | | | |
|---|---|---|---|---|
| 7,314,531 | B2 * | 1/2008 | Ishizaka | H01F 1/0577 148/302 |
| 7,390,369 | B2 | 6/2008 | Odaka et al. | |
| 8,152,936 | B2 * | 4/2012 | Tsubokura | H01F 1/0577 420/83 |
| 8,157,927 | B2 * | 4/2012 | Enokido | H01F 1/0577 148/101 |
| 2006/0165550 | A1 * | 7/2006 | Enokido | H01F 1/0577 420/40 |
| 2007/0199624 | A1 | 8/2007 | Shintani et al. | |
| 2010/0200121 | A1 | 8/2010 | Shintani et al. | |
| 2012/0024429 | A1 * | 2/2012 | Hayakawa | H01F 1/0577 148/302 |
| 2012/0235778 | A1 * | 9/2012 | Kunieda | H01F 1/0577 335/302 |
| 2014/0247100 | A1 * | 9/2014 | Tsubokura | H01F 1/053 419/33 |
| 2014/0286815 | A1 * | 9/2014 | Ishiyama | H01F 1/053 419/33 |
| 2014/0286816 | A1 * | 9/2014 | Kato | H01F 1/053 419/33 |
| 2014/0308152 | A1 * | 10/2014 | Tsubokura | H01F 1/053 419/33 |

FOREIGN PATENT DOCUMENTS

| | | |
|---|---|---|
| JP | B2-3693838 | 9/2005 |
| JP | A-2006-265609 | 10/2006 |
| JP | A-2008-264875 | 11/2008 |
| JP | A-2011-210838 | 10/2011 |
| WO | 2004/094090 A1 | 11/2004 |
| WO | WO 2005/095024 A1 | 10/2005 |

OTHER PUBLICATIONS

Apr. 15, 2014 International Preliminary Report of Patentability issued in International Application No. PCT/JP2012/076346.
Apr. 15, 2014 International Preliminary Report of Patentability issued in International Application No. PCT/JP2012/076324.
Jan. 22, 2013 International Search Report issued in International Patent Application No. PCT/JP2012/076327.
Jan. 22, 2013 International Search Report issued in International Patent Application No. PCT/JP2012/076346.
Jan. 22, 2013 International Search Report issued in International Patent Application No. PCT/JP2012/076324.
Jan. 22, 2013 International Search Report issued in International Patent Application No. PCT/JP2012/076310.
U.S. Appl. No. 14/351,199, filed Apr. 11, 2014 in the name of Kato et al.
U.S. Appl. No. 14/350,438, filed Apr. 8, 2014 in the name of Tsubokura et al.
U.S. Appl. No. 14/350,728, filed Apr. 9, 2014 in the name of Tsubokura et al.
Apr. 15, 2014 International Preliminary Report on Patentability issued in International Patent Application No. PCT/JP2012/076310.
Aug. 19, 2016 Office Action Issued in U.S Appl. No. 14/350,438.
Aug. 22, 2016 Office Action issued in U.S. Appl. No. 14/351,199.

* cited by examiner (B)

R-T-B BASED ALLOY STRIP, AND R-T-B BASED SINTERED MAGNET AND METHOD FOR PRODUCING SAME

TECHNICAL FIELD

The present invention relates to an R-T-B based alloy strip, and to an R-T-B based sintered magnet and a method for producing the same.

BACKGROUND ART

For driving motors used in a variety of different fields, there is increasing demand for smaller sizes and lighter weights, as well as increased efficiency, in line with the goal of reducing installation space and lowering cost. Along with this demand there is a desire for techniques that allow further improvement in, for example, the magnetic properties of sintered magnets to be used in driving motors.

R-T-B based rare earth sintered magnets have been used in the past as sintered magnets with high magnetic properties. It has been attempted to improve the magnetic properties of R-T-B based sintered magnets using heavy rare earth metals such as Dy and Tb, which have large anisotropic magnetic fields $H_A$. However, with the rising costs of rare earth metal materials in recent years, there has been a strong desire to reduce the amount of usage of expensive heavy rare earth elements. In light of this situation, it has been attempted to improve magnetic properties by micronizing the structures of R-T-B based sintered magnets.

Incidentally, R-T-B based sintered magnets are produced by powder metallurgy methods. In production methods by powder metallurgy, first the starting material is melted and cast, to obtain an alloy strip containing the R-T-B based alloy. Next, the alloy strip is ground to prepare alloy powder having particle diameters of between several μm and several tens of μm. The alloy powder is then molded and sintered to produce a sintered compact. Next, the obtained sintered compact is worked to the prescribed dimensions. In order to improve the corrosion resistance, the sintered compact may be subjected to plating treatment if necessary to form a plating layer. It is thus possible to obtain an R-T-B based sintered magnet.

In the production method described above, melting and casting of the starting material are usually accomplished by a strip casting method. A strip casting method is a method in which the molten alloy is cooled with a cooling roll to form an alloy strip. In order to improve the magnetic properties of R-T-B based sintered magnets, it has been attempted to control the alloy structure by adjusting the cooling rate in the aforementioned strip casting method. For example, PTL 1 proposes obtaining an alloy strip comprising chill crystals, particulate crystals and columnar crystals with prescribed particle diameters, by a strip casting method.

FIG. 15 and FIG. 16 are metallographic microscope photographs showing 100× enlarged views of the surface of an R-T-B based alloy strip produced by a conventional strip casting method. As seen in FIGS. 15 and 16, the R-T-B based alloy strip comprises crystals of various sizes containing a $R_2T_{14}B$ phase.

CITATION LIST

Patent Literature

[PTL 1] Japanese Patent No. 3693838 specification

SUMMARY OF INVENTION

Technical Problem

With an alloy strip such as described in PTL 1, however, the poor grindability results in high variation in the particle diameters of the ground alloy powder, and the dispersibility of the R-rich phase in the alloy powder is also poor. When such alloy powder is used to produce a sintered magnet, the non-uniform shapes and sizes of the crystal grains usually make it difficult to significantly improve the magnetic properties. Consequently, it is desirable to establish production techniques that allow further improvement in the magnetic properties of R-T-B based sintered magnets.

The coercive force (HcJ) and residual flux density (Br) of a sintered magnet have established relationships represented by the following formulas (1) and (2).

$$HcJ=\alpha\cdot H_A-N\cdot Ms \quad (1)$$

$$Br=Ms\cdot(\rho/\rho_0)\cdot f\cdot A \quad (2)$$

In formula (1), α is a coefficient representing the independence of the crystal grains, $H_A$ represents the anisotropic magnetic field that is dependent on the structure, N represents the local demagnetizing field dependent on shape, etc., and Ms represents the saturation magnetization of the main phase. Also, in formula (2), ρ represents the sintered density, $\rho_0$ represents the true density, f represents the volume ratio of the main phase, f represents the volume ratio of the main phase, and A represents the degree of orientation of the main phase. Of these coefficients, $H_A$, Ms and f are dependent on the structure of the sintered magnet, and N is dependent on the shape of the sintered magnet. As clearly seen from formula (1), increasing a in formula (1) can increase the coercive force. This suggests that controlling the structure of the alloy powder used in the compact for a sintered magnet allows the coercive force to be increased.

It is an object of the present invention, which has been accomplished in light of these circumstances, to provide an alloy strip that can increase the coercive force of an R-T-B based sintered magnet. It is another object of the invention to provide an R-T-B based sintered magnet that does not employ an expensive heavy rare earth element and has sufficiently excellent coercive force, as well as a method for producing it.

Solution to Problem

The present inventors have conducted much research centered on alloy strip structures with the aim of increasing the magnetic properties of R-T-B based sintered magnets. As a result, it was found that it is useful to specify the microstructure of the surface of the alloy strip.

Specifically, the invention provides an R-T-B based alloy strip comprising dendritic crystals including an $R_2T_{14}B$ phase, wherein on at least one surface, the average value for the widths of the dendritic crystals is no greater than 60 μm, and the number of crystal nuclei in the dendritic crystals is at least 500 per 1 mm square area (1 mm×1 mm).

The R-T-B based alloy strip of the invention has at least a prescribed number of crystal nuclei per unit area on at least one surface. Such dendritic crystals have minimal grow in the in-plane direction of the R-T-B based alloy strip. Therefore, $R_2T_{14}B$ phases grow in a columnar fashion in the thickness direction. An R-rich phase is produced surrounding the $R_2T_{14}B$ phases that have grown in a columnar fashion, and the R-rich phase fractures preferentially during grinding. Thus, grinding of an R-T-B based alloy strip having such a structure can yield alloy powder in a uniformly dispersed state without segregation of the R-rich phase, compared to the prior art. In addition, firing such an alloy powder can minimize aggregation of the R-rich phase and abnormal grain growth of the crystal grains, to obtain an R-T-B based sintered magnet having high coercive force.

The R-T-B based alloy strip of the invention preferably has an aspect ratio of 0.8 or greater for a group of crystals comprising a plurality of dendritic crystals on at least one surface. This can improve the homogeneity of the shapes of the dendritic crystals 40, and yield alloy powder that is even more micronized and has the R-rich phase in a uniformly dispersed state.

The average value for the widths of the dendritic crystals in the R-T-B based alloy strip of the invention is preferably 25 μm or greater. This can further accelerate growth of the $R_2T_{14}B$ phase in the thickness direction of the alloy strip. It will thus be possible to obtain alloy powder with small particle diameters and low particle diameter variation.

According to another aspect, the present invention provides an R-T-B based sintered magnet obtained by molding and firing alloy powder obtained by grinding the aforementioned R-T-B based alloy strip. The R-T-B based sintered magnet has sufficiently excellent coercive force because it uses as starting material an alloy powder with small particle diameters and a uniformly dispersed R-rich phase.

According to yet another aspect, the invention provides a method for producing an R-T-B based sintered magnet, which includes a step of grinding the aforementioned alloy strip to prepare an alloy powder, and a step of molding and firing the alloy powder to produce an R-T-B based sintered magnet. Since this production method employs alloy powder with small particle diameters and a uniformly dispersed R-rich phase, it can yield an R-T-B based sintered magnet having sufficiently excellent coercive force.

Advantageous Effects of Invention

According to the invention it is possible to provide an alloy strip that can increase the coercive force in an R-T-B based sintered magnet. It is also possible to provide an R-T-B based sintered magnet having sufficiently excellent coercive force, as well as a method for producing it.

DESCRIPTION OF EMBODIMENTS

Figure 1:
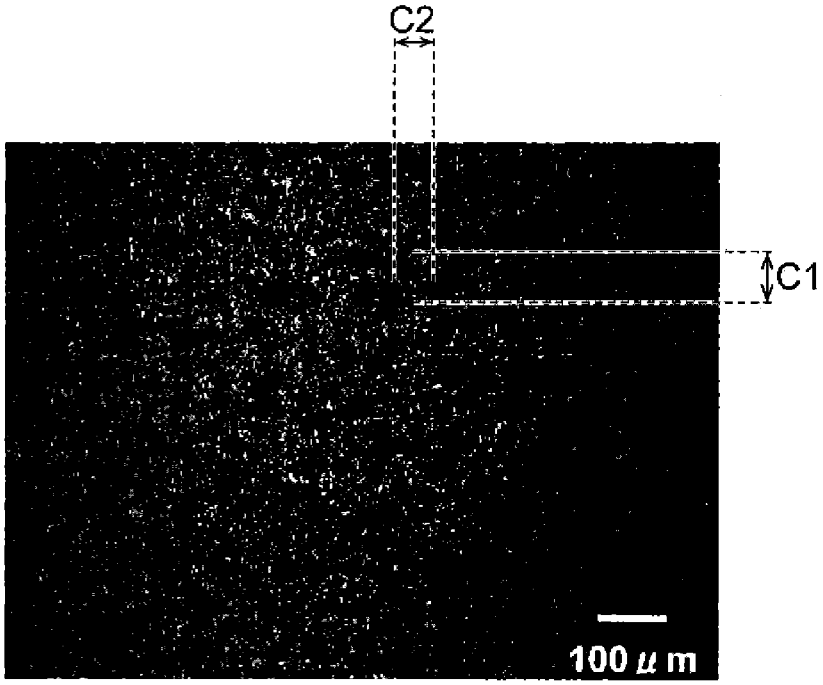
FIG. 1 is a metallographic microscope photograph (magnification: 100×) of one surface of an R-T-B based alloy strip according to an embodiment of the invention.

Preferred embodiments of the invention will now be explained with reference to the accompanying drawings where necessary. For the drawings, identical or corresponding elements will be referred to by like reference numerals and will be explained only once.

<R-T-B Based Alloy Strip>

FIG. 1 is a metallographic microscope photograph (magnification: 100×) of one surface of an R-T-B based alloy strip according to this embodiment. The alloy strip of this embodiment comprises an $R_2T_{14}B$ crystal phase and an R-rich phase. Throughout the present specification, R represents elements including at least one selected from among rare earth elements, T represents elements including at least one of iron and cobalt, and B represents boron.

The term "rare earth element", for the purpose of the present specification, refers to scandium (Sc), yttrium (Y) and lanthanoid elements belonging to Group 3 of the long Periodic Table, the lanthanoid elements including, for example, lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) and lutetium (Lu).

Figure 2:
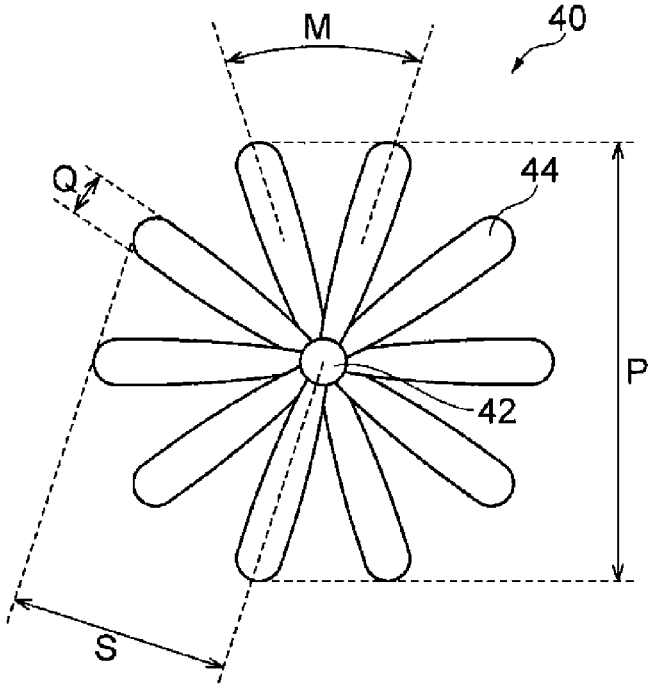
FIG. 2 is a plan view schematically showing dendritic crystals in an R-T-B based alloy strip according to an embodiment of the invention.

One surface of the R-T-B based alloy strip of this embodiment is composed of a plurality of petal-like dendritic crystals containing a $R_2T_{14}B$ phase, as shown in FIG. 1. FIG. 2 is an enlarged plan view schematically showing a dendritic crystal composing one surface of an R-T-B based alloy strip. The dendritic crystal 40 has a crystal nucleus 42 at the center section, and filler-shaped crystals 44 extending in a radial fashion with the crystal nucleus 42 as the origin.

The width P of the dendritic crystal 40 is determined as the maximum distance among the distances between tips of two different filler-like crystals 44. Normally, the width P is the distance between the tips of two filler-like crystals 44 present at roughly opposite ends across the crystal nucleus 42. Throughout the present specification, the average value for the width P of a dendritic crystal 40 is determined in the following manner. In an image of one surface of the metal foil strip enlarged 200× with a metallographic microscope, 100 dendritic crystals 40 are arbitrarily selected and the width P of each of the dendritic crystals 40 is measured. The arithmetic mean value of the measured values is recorded as the average value for the widths P of the dendritic crystals 40.

The average value for the width P of the dendritic crystals 40 is preferably 25 to 60 μm. The upper limit for the average value for the width P is preferably 55 μm, more preferably 50 μm and even more preferably 48 μm. This can reduce the sizes of the dendritic crystals 40 and yield even finer alloy powder. The lower limit for the average value of the width P is preferably 30 μm, more preferably 35 μm and even more preferably 38 μm. Growth of the $R_2T_{14}B$ phase in the thickness direction of the alloy strip will thus be even further accelerated. It will thus be possible to obtain alloy powder with small particle diameters and low particle diameter variation.

Figure 15:
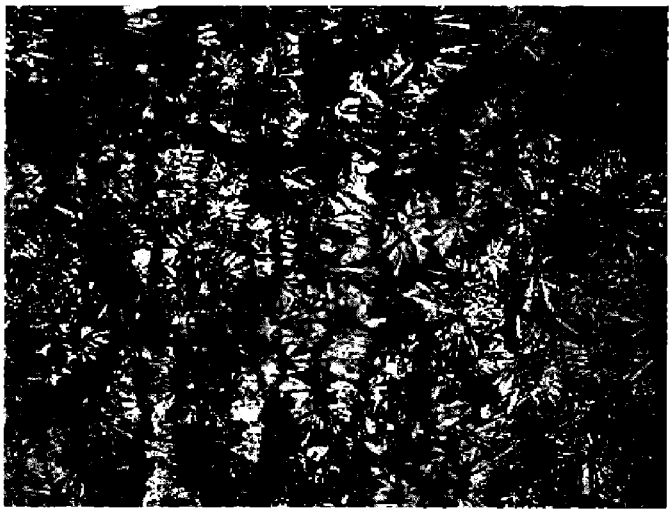
FIG. 15 is a metallographic microscope photograph (magnification: 100×) of one surface of a conventional R-T-B based alloy strip.
Figure 16:
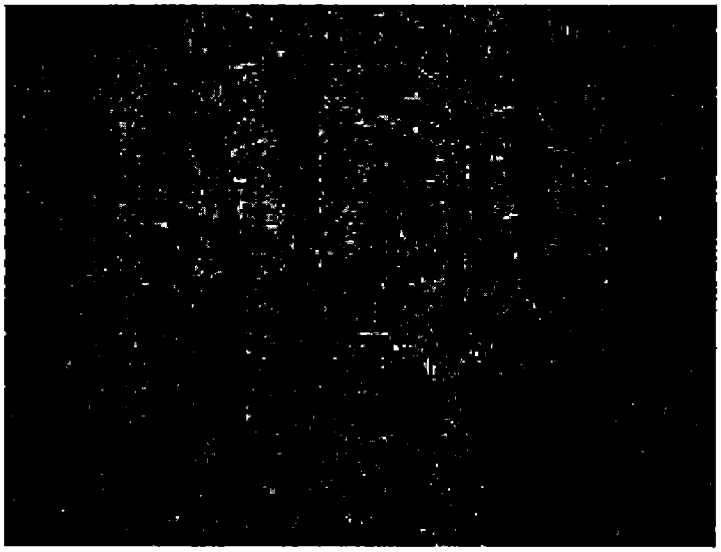
FIG. 16 is a metallographic microscope photograph (magnification: 100×) of one surface of a conventional R-T-B based alloy strip.

The surface of the R-T-B based alloy strip of this embodiment shown in FIG. 1 has more crystal nuclei 42 per unit area on one surface, and smaller widths of the dendritic crystals 40, compared to the surfaces of the conventional R-T-B based alloy strips shown in FIGS. 15 and 16. In addition, the spacing M between filler-like crystals 44 composing the dendritic crystal 40 is smaller and the sizes of the filler-like crystals 44 are also smaller. Specifically, the surface of the R-T-B based alloy strip of this embodiment is composed of dendritic crystals 40 that are fine and have limited size variation. The homogeneity of the dendritic crystals 40 is thus significantly improved. Also, the homogeneity of the size of the length S and width Q of filler-like crystals 44 is also significantly improved on the surface of the R-T-B based alloy strip of this embodiment.

As shown in FIG. 1, the dendritic crystals 40 lie in one direction overall (the up-down direction in FIG. 1) on one surface of the R-T-B based alloy strip, forming a crystal group. The aspect ratio is calculated as C2/C1, where C1 is the lengths of the long axes of the crystal group of the dendritic crystals and C2 is the lengths of the short axes perpendicular to the long axes, as seen in FIG. 1. The average value for the aspect ratio calculated in this manner is preferably 0.8 or greater, more preferably 0.7 to 1.0, even more preferably 0.8 to 0.98 and most preferably 0.88 to 0.97. If the average value of the aspect ratio is within this range, the homogeneity of the shapes of the dendritic crystals 40 will be increased, and growth of the $R_2T_{14}B$ phase in the thickness direction of the alloy strip will be more uniform. Also, by limiting the widths of the dendritic crystals 40 to within the range specified above, it is possible to obtain an alloy strip that is even more micronized and has a uniformly dispersed R-rich phase. It will thus be possible to obtain alloy powder with small particle diameters and low particle diameter variation. The average value for the aspect ratio of the crystal group of the dendritic crystals is the arithmetic mean value for the ratio (C2/C1) for 100 arbitrarily selected crystal groups.

Throughout the present specification, the average value for the aspect ratio was determined in the following manner. In an image of one surface of the metal foil strip enlarged 200× with a metallographic microscope, 100 crystal groups are arbitrarily selected, and the lengths C1 of the long axes and the lengths C2 of the short axes of each of the crystal groups are measured. The arithmetic mean value for the crystal group ratio (C2/C1) is the average value of the aspect ratio.

For one surface of the R-T-B based alloy strip, the number of dendritic crystal nuclei 42 generated is 500 or greater, preferably 600 or greater, more preferably 700 or greater and even more preferably 763 or greater, per 1 mm square. Since the number of crystal nuclei 42 generated is thus high, the size per single crystal nucleus 42 is small, and an R-T-B based alloy strip having a micronized structure can be obtained.

The R-T-B based alloy strip of this embodiment may have the structure described above on at least one surface. If at least one surface has such a structure, it will be possible to obtain alloy powder having small particle diameters and a uniformly dispersed R-rich phase. An example of a method for producing an R-T-B based alloy strip for this embodiment will now be described.

<Method for Producing R-T-B Based Alloy Strip>

Figure 3:
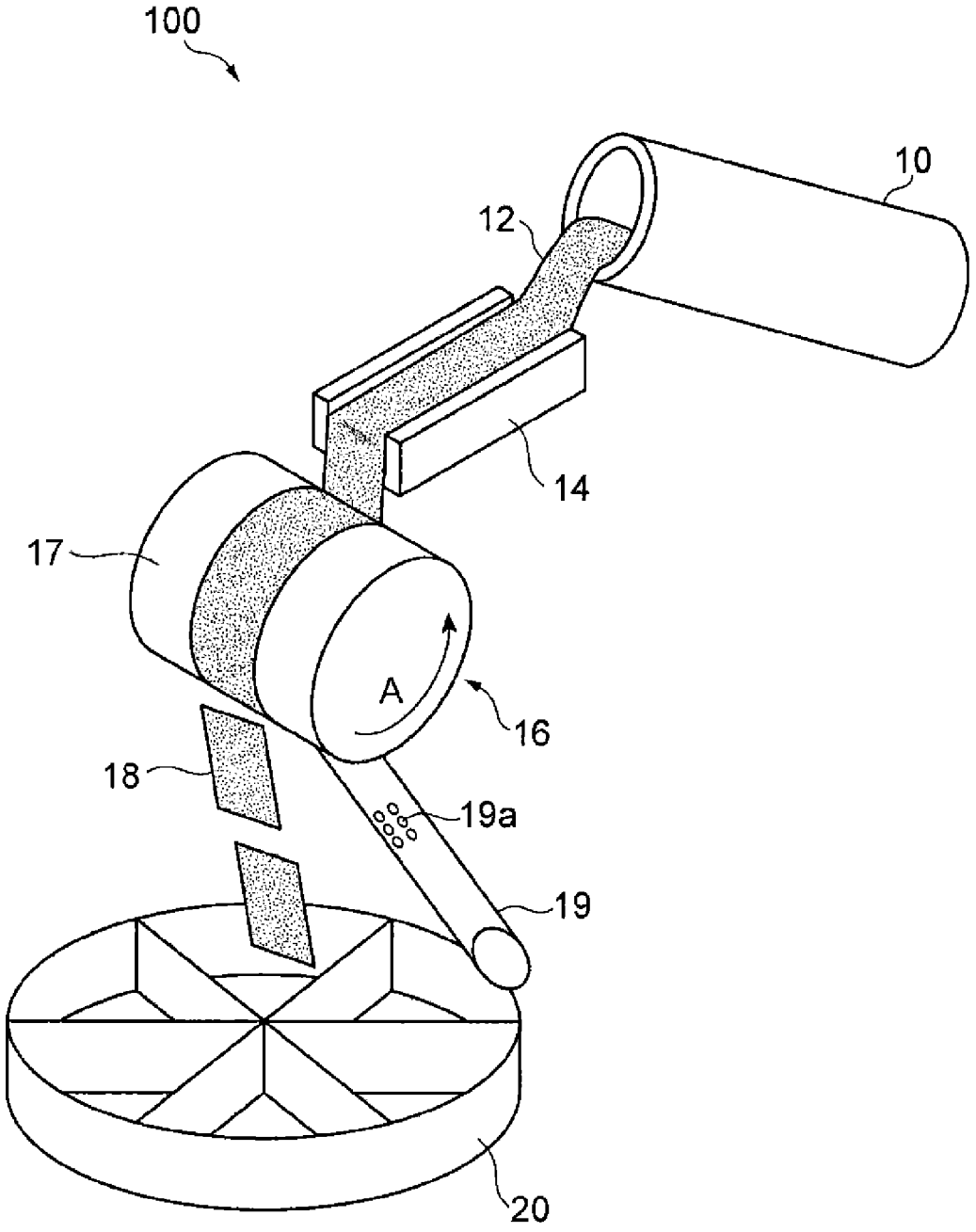
FIG. 3 is a schematic diagram showing an example of a method for producing an alloy strip according to the invention.

FIG. 3 is a schematic diagram of an apparatus for production of the R-T-B based alloy strip of this embodiment. The R-T-B based alloy strip of this embodiment may be produced by a strip casting method using a production apparatus such as shown in FIG. 3. The method for producing an alloy strip according to this embodiment comprises a melting step in which a molten R-T-B based alloy is prepared, a first cooling step in which the molten alloy is poured onto the roll surface of the cooling roll rotating in the circumferential direction, cooling the molten alloy by the roll surface to produce crystal nuclei, and solidifying at least a portion of the molten alloy, and a second cooling step in which the alloy containing crystal nuclei is further cooled to obtain an alloy strip. Each of these steps will now be explained in detail.

In the melting step, a starting material comprising at least one rare earth metal or rare earth alloy, or pure iron, ferroboron or an alloy thereof, is introduced into a high-frequency melting furnace 10. In the high-frequency melting furnace 10, the starting material is heated to 1300° C. to 1400° C. to prepare a molten alloy 12.

In the first cooling step, the molten alloy 12 is transferred to a tundish 14. Next, the molten alloy is poured from the tundish 14 onto the roll surface of the cooling roll 56 rotating at a prescribed speed in the direction of the arrow A. The molten alloy 12 contacts with the roll surface 17 of the cooling roll 16 and loses heat by heat exchange. As the molten alloy 12 cools, crystal nuclei are formed in the molten alloy and at least part of the molten alloy 12 solidifies. For example, an $R_2T_{14}B$ phase (melting temperature of about 1100° C.) is formed first, and then at least part of the R-rich phase (melting temperature of about 700° C.) solidifies. The crystal deposition is affected by the structure of the roll surface 17 with which the molten alloy 12 contacts. A concavoconvex pattern, comprising mesh-like recesses and raised sections formed by recesses, is formed on the roll surface 17 of the cooling roll 16.

Figure 4:
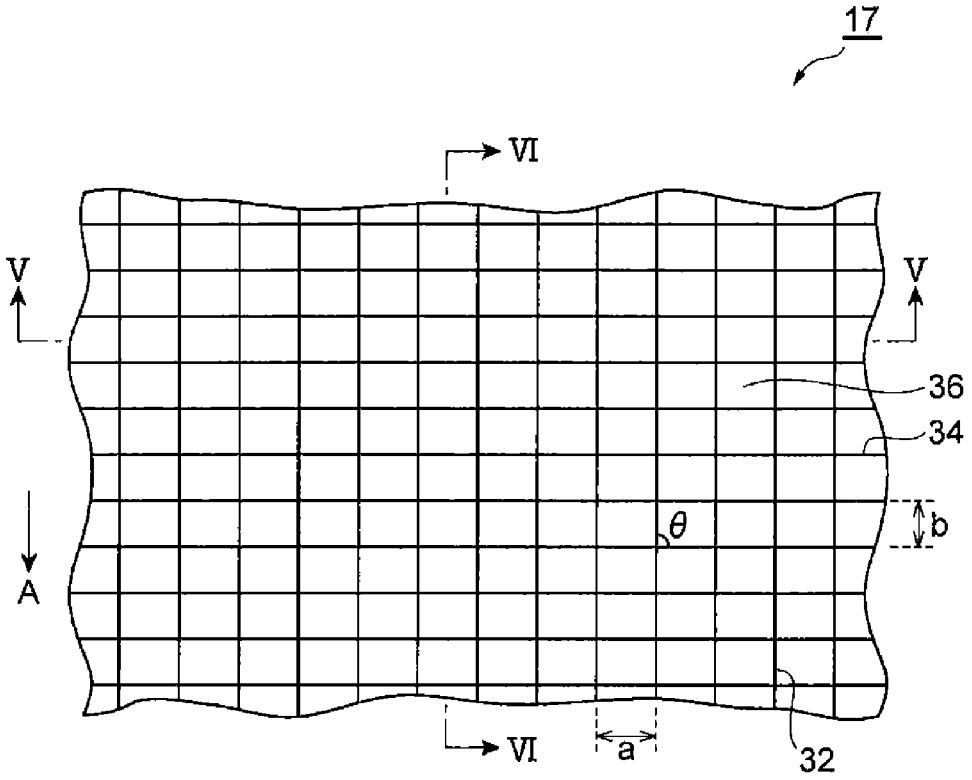
FIG. 4 is an enlarged plan view showing an example of the roll surface of a cooling roll used for production of an alloy strip according to the invention.

FIG. 4 is a schematic diagram showing a flat enlarged view of part of a roll surface 17. Mesh-like grooves are formed in the roll surface 17, and these form the concavoconvex pattern. Specifically, the roll surface 17 has a plurality of first recesses 32 arranged at a prescribed spacing a along the circumferential direction of the cooling roll 16 (the direction of the arrow A); and has a plurality of second recesses 34 arranged essentially perpendicular to the first recesses 32 and at a prescribed spacing b parallel to the axial direction of the cooling roll 16. The first recesses 32 and the second recesses 34 are essentially straight linear grooves having prescribed depths. Raised sections 36 are formed by the first recesses 32 and the second recesses 34.

The angle θ formed by the first recesses 32 and second recesses 34 is preferably 80-100° and more preferably 85-95°. By specifying such an angle θ, it will be possible for columnar growth of the crystal nuclei of the $R_2T_{14}B$ phase deposited on the raised sections 36 of the roll surface 17 to proceed toward the thickness direction of the alloy strip.

Figure 5:
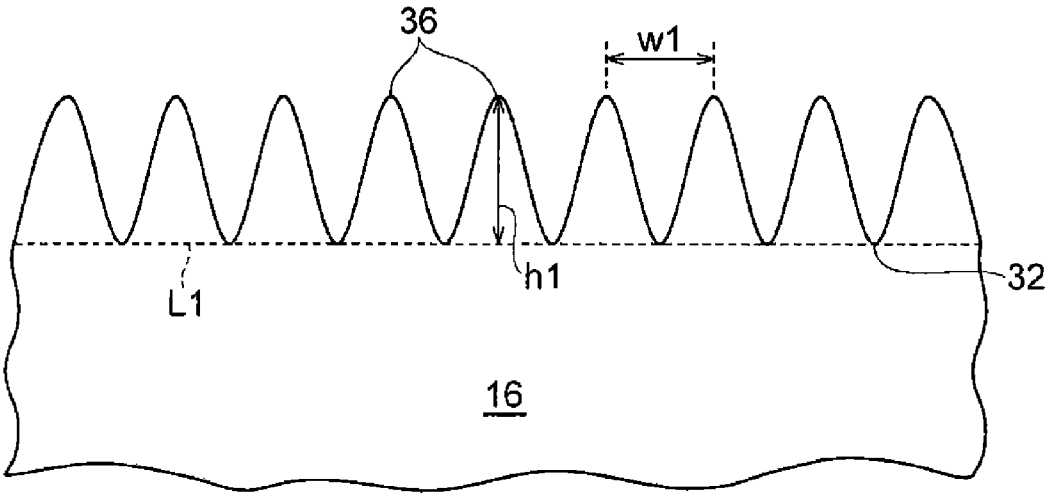
FIG. 5 is a schematic cross-sectional view showing an example of the cross-sectional structure near the roll surface of a cooling roll used for production of an alloy strip according to the invention.

FIG. 5 is a schematic enlarged cross-sectional view showing a cross-section of FIG. 4 along line V-V. Specifically, FIG. 5 is a schematic cross-sectional view showing a portion of the cross-sectional structure of a cooling roll 16 cut through the axis on a plane parallel to the axial direction. The heights h1 of the raised sections 36 can be calculated as the shortest distances between the apexes of the raised sections 36 and a straight line L1 passing through the bases of the first recesses 32 and parallel to the axial direction of the cooling roll 16, in the cross-section shown in FIG. 5. Also, the spacing w1 of the raised sections 36 can be calculated as the distance between apexes of adjacent raised sections 36, in the cross-section shown in FIG. 5.

Figure 6:
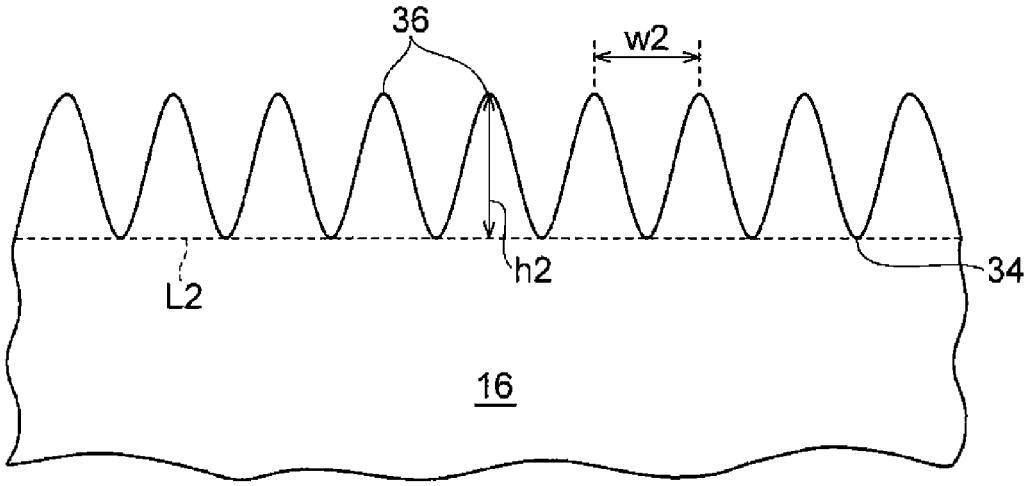
FIG. 6 is a schematic cross-sectional view showing an example of the cross-sectional structure near the roll surface of a cooling roll used for production of an alloy strip according to the invention.

FIG. 6 is a schematic enlarged cross-sectional view showing a cross-section of FIG. 4 along line VI-VI. Specifically, FIG. 6 is a schematic cross-sectional view showing a portion of the cross-sectional structure of a cooling roll 16 cut on a plane parallel to the side. The heights h2 of the raised sections 36 can be calculated as the shortest distances between the apexes of the raised sections 36 and a straight line L2 passing through the bases of the second recesses 34 and perpendicular to the axial direction of the cooling roll 16, in the cross-section shown in FIG. 6. Also, the spacing w2 of the raised sections 36 can be calculated as the distance between apexes of adjacent raised sections 36, in the cross-section shown in FIG. 6.

Throughout the present specification, the average value H of the heights of the raised sections 36 and the average value W of the spacing between raised sections 36 are calculated in the following manner. Using a laser microscope, a profile image (magnification: 200×) was taken of a cross-section of the cooling roll 16 near the roll surface 17, as shown in FIGS. 5 and 6. In these images, 100 points were measured for both heights h1 and heights h2 of arbitrarily selected raised sections 36. Here, measurement was made only for heights h1 and h2 that were 3 μm or greater, including no data for heights of less than 3 μm. The arithmetic mean value of measurement data for a total of 200 points was recorded as the average value for the heights of the raised sections 36.

Also, in the same image, 100 points were measured for both spacings w1 and spacings w2 of arbitrarily selected raised sections 36. Measurement of the spacings was conducted considering only heights h1 and h2 of 3 μm and greater as raised sections 36. The arithmetic mean value of measurement data for a total of 200 points was recorded as the average value W for the spacings of the raised sections 36. When it is difficult to observe a concavoconvex pattern on the roll surface 17 with a scanning electron microscope, a replica may be formed by replicating the concavoconvex pattern of the roll surface 17, and the surface of the replica observed with a scanning electron microscope and measured as described above. A replica can be formed using a commercially available kit (SUMP SET by Kenis, Ltd.).

The concavoconvex pattern of the roll surface 17 can be adjusted by working the roll surface 17 with a short wavelength laser, for example.

The average value H of the heights of the raised sections 36 is preferably 7 to 20 μm. This will cause the recesses 32, 34 to be thoroughly saturated with the molten alloy and allow adhesiveness between the molten alloy 12 and roll surface 17 to be sufficiently increased. The upper limit for the average value H is more preferably 16 μm and even more preferably 14 μm, from the viewpoint of more thoroughly saturating the recesses 32, 34 with the molten alloy. The lower limit for the average value H is more preferably 8.5 μm and even more preferably 8.7 μm, from the viewpoint of obtaining $R_2T_{14}B$ phase crystals with sufficiently high adhesiveness between the molten alloy and the roll surface 17, while also having more uniform orientation in the thickness direction of the alloy strip.

The average value W of the spacing between raised sections 36 is 40 to 100 μm. The upper limit for the average value W is preferably 80 μm, more preferably 70 μm and even more preferably 67 μm, from the viewpoint of further reducing the widths of the $R_2T_{14}B$ phase columnar crystals and obtaining magnet powder with a small particle diameter. The lower limit for the average value W is preferably 45 μm and more preferably 48 μM. This will allow an R-T-B based sintered magnet to be obtained having even higher magnetic properties.

The surface roughness Rz of the roll surface 17 is preferably 3 to 5 μm, more preferably 3.5 to 5 μm and even more preferably 3.9 to 4.5 μm. If the Rz value is excessive the thickness of the strip will vary, tending to increase variation in the cooling rate. On the other hand, if Rz is too small, adhesiveness between the molten alloy and the roll surface 17 will be insufficient, and the molten alloy or alloy strip will tend to detach from the roll surface 17 earlier than the targeted time. In this case, the molten alloy migrates to the secondary cooling section 20 without sufficient progression of heat loss of the molten alloy. Therefore, the alloy strips 18 will tend to inconveniently stick together at the secondary cooling section 20.

The surface roughness Rz, for the purpose of the present specification, is the ten-point height of irregularities and is the value measured according to JIS B 0601-1994. Rz can be measured using a commercially available measuring apparatus (for example, SURFTEST by Mitsutoyo Corp.).

For this embodiment, a cooling roll 16 having a roll surface 17 such as shown in FIGS. 4 to 6 is used, and therefore when the molten alloy 12 is poured onto the roll surface 17 of the cooling roll 16, the molten alloy 12 first contacts with the raised sections 36. The contact sections serve as origins for generation of dendritic crystals 40 comprising an $R_2T_{14}B$ phase as shown in FIG. 2. Many such dendritic crystals 40 are generated on the roll surface 17 and the widths P of each of the dendritic crystals 40 are sufficiently small, such that the growth is in a columnar fashion in the thickness direction of the alloy strip.

The cooling roll 16 and roll surface 17 have prescribed heights and have raised sections 36 arranged in a prescribed spacing. This results in generation of numerous $R_2T_{14}B$ phase crystal nuclei 42 on the roll surface 17, which then form dendritic crystals 40. Furthermore, the dendritic crystals 40 also grow in the thickness direction of the R-T-B based alloy strip, forming $R_2T_{14}B$ phase columnar crystals.

The cooling rate in the first cooling step is preferably 1000° C. to 3000° C./sec and more preferably 1500° C. to 2500° C./sec, from the viewpoint of adequately micronizing the structure of the obtained alloy strip while inhibiting generation of heterophases. If the cooling rate is below 1000° C./sec, an α-Fe phase will tend to be readily deposited, and if the cooling rate exceeds 3000° C./sec, chill crystals will tend to be readily deposited. Chill crystals are isotropic microcrystals with particle diameters of 1 μm and smaller. High generation of chill crystals tends to impair the magnetic properties of the finally obtained R-T-B based sintered magnet.

The cooling rate can be controlled, for example, by adjusting the temperature or flow rate of cooling water flowing through the interior of the cooling roll 16. The cooling rate can also be adjusted by varying the material of the roll surface 17 of the cooling roll 16. The material used for the cooling roll may be a copper sheet with a purity of 95 mass %. for example.

The second cooling step is a step in which the alloy strip 18 containing the crystal nuclei generated by the first cooling step is further cooled by a secondary cooling section 20. There are no particular restrictions on the cooling method in the second cooling step, and any conventional cooling method may be employed. For example, the secondary cooling section 20 may be one provided with a gas tube 19 having a gas blow hole 19*a*, wherein cooling gas is blown through the gas blow hole 19*a* onto the alloy strip accumulated on a rotating table rotating in the circumferential direction. The alloy strip 18 can be sufficiently cooled in this manner. The alloy strip is recovered after sufficient cooling with the secondary cooling section 20.

The thickness of the R-T-B based alloy strip of this embodiment is preferably no greater than 0.5 mm and more preferably 0.1 to 0.5 mm. If the thickness of the alloy strip is too large, the heat loss effect will be insufficient and the structure of the columnar crystals will be non-uniform. Also, deposition of an α-Fe phase is seen near the free surface. When an alloy strip with α-Fe phase deposition is micronized, this tends to lower the magnetic properties and increase variation in the particle diameter of the alloy powder after grinding.

The R-T-B based alloy strip of this embodiment comprises an $R_2T_{14}B$ phase as the main phase and an R-rich phase as the heterophase. Here, the main phase is the crystal phase most abundantly present in the alloy strip, while the heterophase is the crystal phase different from the main phase and is the crystal phase primarily present at the grain boundaries of the main phase. An R-rich phase is a phase with a higher concentration of non-magnetic rare earth elements such as Nd than the $R_2T_{14}B$ phase. The R-T-B based alloy strip of this embodiment may also contain an α-Fe phase and chill crystals in addition to the R-rich phase as the heterophase. However, the total heterophase content is preferably no greater than 10 mass %, more preferably no greater than 7 mass % and even more preferably no greater than 5 mass %, with respect to the total R-T-B based alloy strip. By thus reducing the total heterophase content, it is possible to obtain an R-T-B based sintered magnet with both excellent residual flux density and coercive force.

Figure 7:
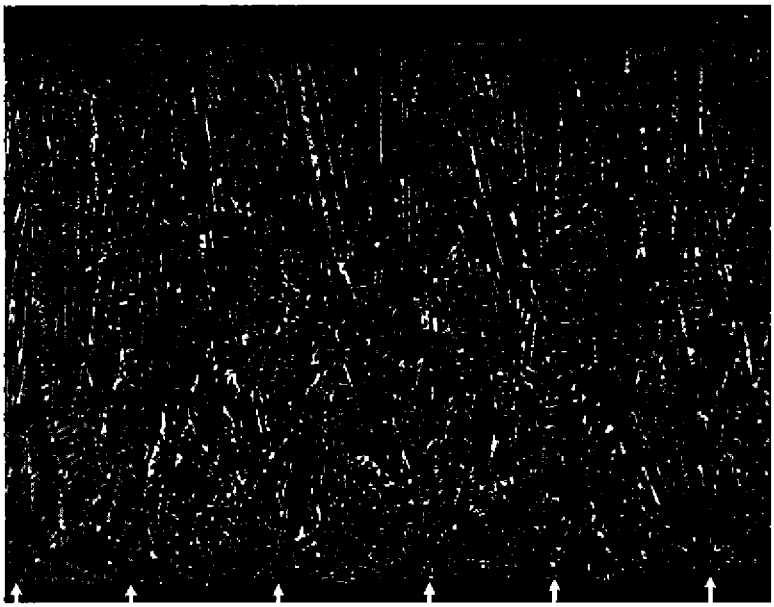
FIG. 7 is an SEM-BEI image photograph (magnification: 300×) of a cross-section of an alloy strip according to an embodiment of the invention, along the thickness direction.
Figure 7:
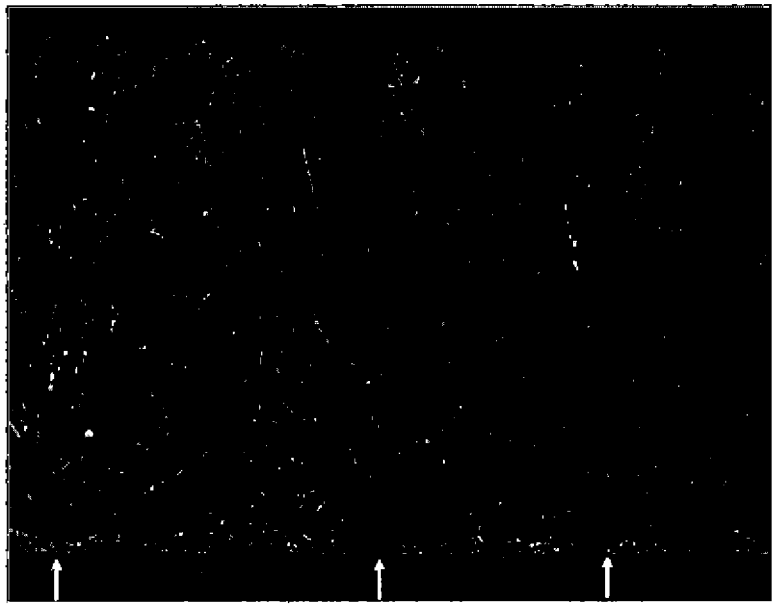

FIG. 7 is a photograph of an SEM (scanning electron microscope)-BEI (backscattered electron image) image, showing a cross-section along the thickness direction of the R-T-B based alloy strip. FIG. 7(A) is an SEM-BEI image photograph (magnification: 300×) showing a cross-section of the R-T-B based alloy strip of this embodiment in the thickness direction. Also, FIG. 7(B) is an SEM-BEI image photograph (magnification: 300×) showing a cross-section of a conventional R-T-B based alloy strip in the thickness direction. In FIGS. 7(A) and (B), the lower side surface of the R-T-B based alloy strip is the contact surface with the roll surface 17 (casting surface). Also, in FIGS. 7(A) and (B) the white sections represent $R_2T_{14}B$ phase crystals and the black sections represent the R-rich phase.

As shown in FIG. 7(A), the R-T-B based alloy strip of this embodiment has the crystal nuclei of numerous $R_2T_{14}B$ phases deposited on the lower surface (see the arrows in the drawing). In addition, $R_2T_{14}B$ phase columnar crystals are oriented from the crystal nuclei in the upward direction of FIG. 7(A), i.e. toward the surface on the opposite side.

On the other hand, as shown in FIG. 7(B), a conventional R-T-B based alloy strip has less deposition of $R_2T_{14}B$ phase crystal nuclei than in FIG. 7(A). In addition, the $R_2T_{14}B$ phase crystals grow not only in the up-down direction but also in the left-right direction. Therefore, the widths (lateral widths) of the $R_2T_{14}B$ phase crystals in the direction perpendicular to the lengthwise direction are increased compared to FIG. 7(A). If the R-T-B based alloy strip has such a structure, it will not be possible to obtain fine alloy powder.

<Method for Producing R-T-B Based Sintered Magnet>

A preferred embodiment of the method for producing an R-T-B based sintered magnet will now be described. The method for producing an R-T-B based sintered magnet according to this embodiment comprises a melting step in which a molten R-T-B based alloy is prepared, a first cooling step in which the molten alloy is poured onto the roll surface of the cooling roll rotating in the circumferential direction, cooling the molten alloy by the roll surface to produce crystal nuclei, and solidifying at least a portion of the molten alloy, and a second cooling step in which the alloy that contains crystal nuclei is further cooled to obtain an R-T-B based alloy strip, a grinding step in which the R-T-B based alloy strip is ground to obtain an R-T-B based alloy powder, a molding step in which the alloy powder is molded to form a compact, and a firing step in which the compact is fired to obtain an R-T-B based sintered magnet. Specifically, the method for producing an R-T-B based sintered magnet according to this embodiment can be carried out using an R-T-B based alloy strip obtained by the aforementioned production method, in the same manner as the method for producing an alloy strip described above from the melting step through to the second cooling step. The steps from the grinding step onward will therefore now be explained.

There are no particular restrictions on the grinding method in the grinding step. The grinding can be carried out in the order of coarse grinding followed by fine grinding. Coarse grinding is preferably carried out in an inert gas atmosphere using, for example, a stamp mill, jaw crusher, Braun mill or the like. Hydrogen storage grinding may also be carried out, in which grinding is performed after hydrogen has been stored. By coarse grinding it is possible to prepare alloy powder with particle diameters of about several hundred μm. The alloy powder prepared by coarse grinding is subjected to fine grinding to a mean particle diameter of 1 to 5 μm, for example, using a jet mill or the like. Grinding of the alloy strip does not necessarily need to be carried out in two stages of coarse grinding and fine grinding, and may instead be carried out in a single step.

In the grinding step, the alloy strip R-rich phase sections undergo fracturing preferentially. Consequently, the particle diameters of the alloy powder depend on the spacing of the R-rich phase. Since, as shown in FIGS. 1 and 2, the alloy strip to be used in the production method of this embodiment has a larger number of deposited crystals on the surface and has smaller-sized dendritic crystals 42 compared to the prior art, grinding can yield alloy powder with a small particle diameter and having a more uniformly dispersed R-rich phase.

In the molding step, the alloy powder is molded in a magnetic field to obtain a compact. Specifically, first the alloy powder is packed into a die situated in an electromagnet. A magnetic field is then applied by the electromagnet and the alloy powder is pressed while orienting the crystal axes of the alloy powder. Molding is thus carried out in a magnetic field to prepare a compact. The molding in a magnetic field may be carried out in a magnetic field of 12.0 to 17.0 kOe, for example, at a pressure of about 0.7 to 1.5 ton/cm$^2$.

In the firing step, the compact obtained by the magnetic field molding is fired in a vacuum or in an inert gas atmosphere to obtain a sintered compact. The firing conditions are preferably set as appropriate for the conditions including the composition, the grinding method and the particle size. For example, the firing temperature may be set to 1000° C. to 1100° C. for a firing time of 1 to 5 hours.

An R-T-B based sintered magnet obtained by the production method of this embodiment employs alloy powder that is sufficiently micronized and has a more uniformly distributed R-rich phase, and thus it is possible to obtain an R-T-B based sintered magnet whose structure is more micronized and uniform than the prior art, and that has sufficiently excellent coercive force. Consequently, the production method of this embodiment allows production of an R-T-B based sintered magnet having sufficiently high coercive force while maintaining residual flux density.

The R-T-B based sintered magnet obtained by the process described above may also be subjected to aging treatment if necessary. By carrying out aging treatment, it is possible to further increase the coercive force of the R-T-B based sintered magnet. Aging treatment is preferably carried out in two stages, for example, under two different temperature conditions such as near 800° C. and near 600° C. Aging treatment under such conditions will tend to result in particularly excellent coercive force. When aging treatment is carried out in a single step, it is preferably at a temperature of near 600° C.

The R-T-B based sintered magnet obtained in this manner has the following composition, for example. Specifically, the R-T-B based sintered magnet comprises R, B, Al, Cu, Zr, Co, O, C and Fe, the content ratio of each of the elements being R: 25 to 37 mass %, B: 0.5 to 1.5 mass %, Al: 0.03 to 0.5 mass %, Cu: 0.01 to 0.3 mass %, Zr: 0.03 to 0.5 mass %, Co: ≤3 mass % (not including 0 mass %), O: ≤0.5 mass % and Fe: 60 to 72 mass %. The composition of the R-T-B based sintered magnet will usually be the same as the composition of the R-T-B alloy strip.

The R-T-B based sintered magnet may contain about 0.001 to 0.5 mass % of unavoidable impurities such as Mn, Ca, Ni, Si, Cl, S and F, in addition to the elements mentioned above. However, the content of these impurities is preferably less than 2 mass % and more preferably less than 1 mass % in total.

The R-T-B based sintered magnet comprises an $R_2T_{14}B$ phase as the main phase and an R-rich phase as the heterophase. Since the R-T-B based sintered magnet is obtained using alloy powder with a small particle diameter and low variation in particle diameter, it has increased structural homogeneity and sufficiently excellent coercive force.

Figure 8:
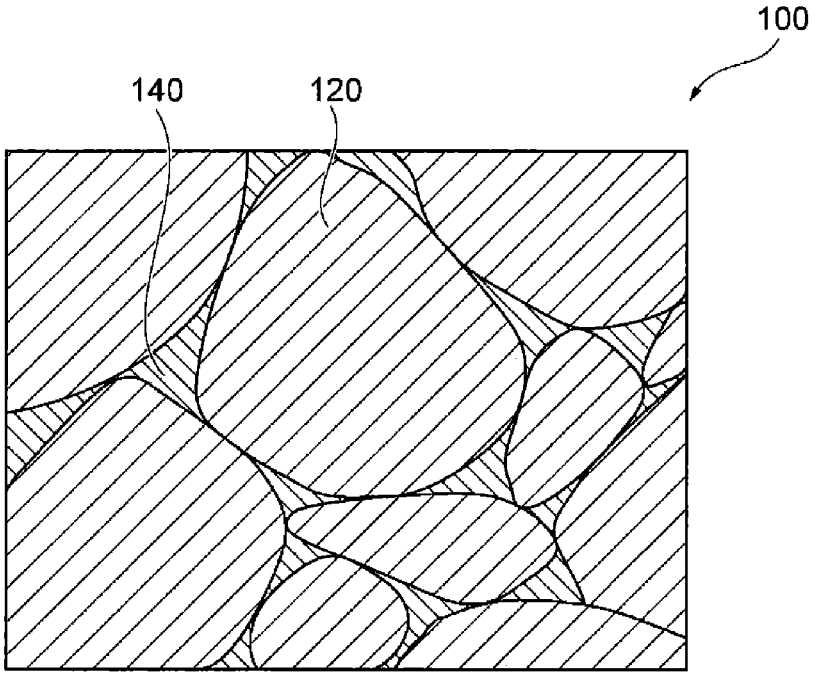
FIG. 8 is a cross-sectional view schematically showing an example of the cross-sectional structure of an R-T-B based sintered magnet according to an embodiment of the invention.

FIG. 8 is a schematic cross-sectional enlarged view showing a portion of a cross-section of the R-T-B based sintered magnet of this embodiment. The R-T-B based sintered magnet 100 preferably comprises at least Fe as a transition element (T), and more preferably it comprises a combination of Fe and a transition element other than Fe. Transition elements other than Fe include Co, Cu and Zr.

The R-T-B based sintered magnet 100 preferably comprises at least one element selected from among Al, Cu, Ga, Zn and Ge. This will allow an R-T-B based sintered magnet 100 to be obtained with even higher coercive force. The R-T-B based sintered magnet 100 also preferably comprises at least one element selected from among Ti, Zr, Ta, Nb, Mo and Hf. By including such elements it is possible to suppress grain growth during firing, and further increase the coercive force of the R-T-B based sintered magnet 100.

The rare earth element content of the R-T-B based sintered magnet 100 is preferably 25 to 37 mass % and more preferably 28 to 35 mass %, from the viewpoint of further increasing the magnetic properties. The B content of the R-T-B based sintered magnet 100 is preferably 0.5 to 1.5 mass % and more preferably 0.7 to 1.2 mass %.

The rare earth elements in the R-T-B based sintered magnet 100 include one or more elements selected from among scandium (Sc), yttrium (Y), lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) and lutetium (Lu).

The R-T-B based sintered magnet 100 may also contain a heavy rare earth element such as Dy, Tb or Ho as R. In this case, the content of heavy rare earth elements in the total mass of the R-T-B based sintered magnet 100 is preferably no greater than 1.0 mass %, more preferably no greater than 0.5 mass % and even more preferably no greater than 0.1 mass %, as the total of the heavy rare earth elements. With the R-T-B based sintered magnet 100 of this embodiment, it is possible to obtain high coercive force even with such a low heavy rare earth element content.

If the rare earth element content is less than 25 mass %, the amount of production of the $R_2T_{14}B$ phase as the main phase of the R-T-B based sintered magnet 100 will be reduced, α-Fe and the like having soft magnetism will be deposited more readily, and HcJ may potentially be reduced. If it is greater than 37 mass %, on the other hand, potentially the volume ratio of the $R_2T_{14}B$ phase may be reduced and the residual flux density lowered.

From the viewpoint of further increasing the coercive force, the R-T-B based sintered magnet 100 preferably contains a total of 0.2 to 2 mass % of at least one type of element selected from among Al, Cu, Ga, Zn and Ge. From the same viewpoint, the R-T-B based sintered magnet 100 also preferably comprises a total of 0.1 to 1 mass % of at least one element selected from among Ti, Zr, Ta, Nb, Mo and Hf.

The content of transition elements (T) in the R-T-B based sintered magnet 100 is the remainder after the aforementioned rare earth elements, boron and added elements.

When Co is included as a transition element, the content is preferably no greater than 3 mass % (not including 0), and more preferably 0.3 to 1.2 mass %. Co forms a phase similar to Fe, and including Co can increase the Curie temperature and corrosion resistance of the grain boundary phase.

As shown in FIG. 8, the oxygen content of the R-T-B based sintered magnet 100 is preferably 300 to 3000 ppm and more preferably 500 to 1500 ppm, from the viewpoint of achieving high levels for both magnetic properties and corrosion resistance. The nitrogen content of the R-T-B based sintered magnet 100 is 200 to 1500 ppm and preferably 500 to 1500 ppm, from the same viewpoint explained above. The carbon content of the R-T-B based sintered magnet 100 is 500 to 3000 ppm and preferably 800 to 1500 ppm, from the same viewpoint explained above.

The crystal grains 120 of the R-T-B based sintered magnet 100 preferably comprise an $R_2T_{14}B$ phase. On the other hand, the triple point regions 140 include a phase with a higher R content ratio than the $R_2T_{14}B$ phase, based on mass compared to the $R_2T_{14}B$ phase. The average value of the area of the triple point regions 140 in a cross-section of the R-T-B based sintered magnet 100 is no greater than 2 $\mu m^2$ and preferably no greater than 1.9 $\mu M^2$, as the arithmetic mean. Also, the standard deviation for the area distribution is no greater than 3 and preferably no greater than 2.6. Since the R-T-B based sintered magnet 100 thus has minimal segregation of the phase with a higher R content than the $R_2T_{14}B$ phase, the area of the triple point regions 140 is low and the variation in area is also reduced. It is thus possible to maintain high levels for both Br and HcJ.

The average value for the area of the triple point regions 140 in the cross-section, and the standard deviation for the area distribution, can be calculated in the following manner. First, the R-T-B based sintered magnet 100 is cut and the cut surface is polished. The polished surface image is observed with a scanning electron microscope. Image analysis is performed and the area of the triple point regions 140 is calculated. The arithmetic mean value for the calculated area is the mean area. Also, the standard deviation for the area of the triple point regions 140 can be calculated based on the area of each of the triple point regions 140 and their average value.

The rare earth element content in the triple point regions 140 is preferably 80 to 99 mass %, more preferably 85 to 99 mass % and even more preferably 90 to 99 mass %, from the viewpoint of obtaining an R-T-B based sintered magnet with sufficiently high magnetic properties and sufficiently excellent corrosion resistance. From the same viewpoint, the rare earth element contents of each of the triple point regions 140 are preferably equal. Specifically, the standard deviation for the content distribution in the triple point regions 140 of the R-T-B based sintered magnet 100 is preferably no greater than 5, preferably no greater than 4 and more preferably no greater than 3.

The mean particle diameter for the crystal grains 120 of the R-T-B based sintered magnet 100 is preferably 0.5 to 5 μm and more preferably 2 to 4.5 from the viewpoint of further increasing the magnetic properties. The mean particle diameter can be calculated by performing image processing of the electron microscope image of a cross-section of the R-T-B based sintered magnet 100, measuring the particle diameters of the individual crystal grains 120, and taking the arithmetic mean of the measured values.

The R-T-B based sintered magnet 100 comprises dendritic crystal grains 2 containing an $R_2T_{14}B$ phase, and grain boundary regions 4 containing a phase with a higher R content than the $R_2T_{14}B$ phase, and preferably it is obtained by molding and firing a ground product of an R-T-B based alloy strip having an average value of no greater than 3 μm for the spacing between the phases with a higher R content than the $R_2T_{14}B$ phase in a cross-section. Since such an R-T-B based sintered magnet 100 is obtained using a ground product that is sufficiently micronized and has a sharp particle size distribution, it is possible to obtain an R-T-B based sintered compact composed of fine crystal grains. In addition, since the phase with a higher R content than the $R_2T_{14}B$ phase will be present in a higher proportion at the outer periphery than in the interior of the ground product, the state of dispersion of the phase with a higher R content than the $R_2T_{14}B$ phase after sintering will tend to be more satisfactory. Thus, the structure of the R-T-B based sintered compact will be micronized and the homogeneity will be improved. It will thereby be possible to further increase the magnetic properties of the R-T-B based sintered compact.

Figure 9:
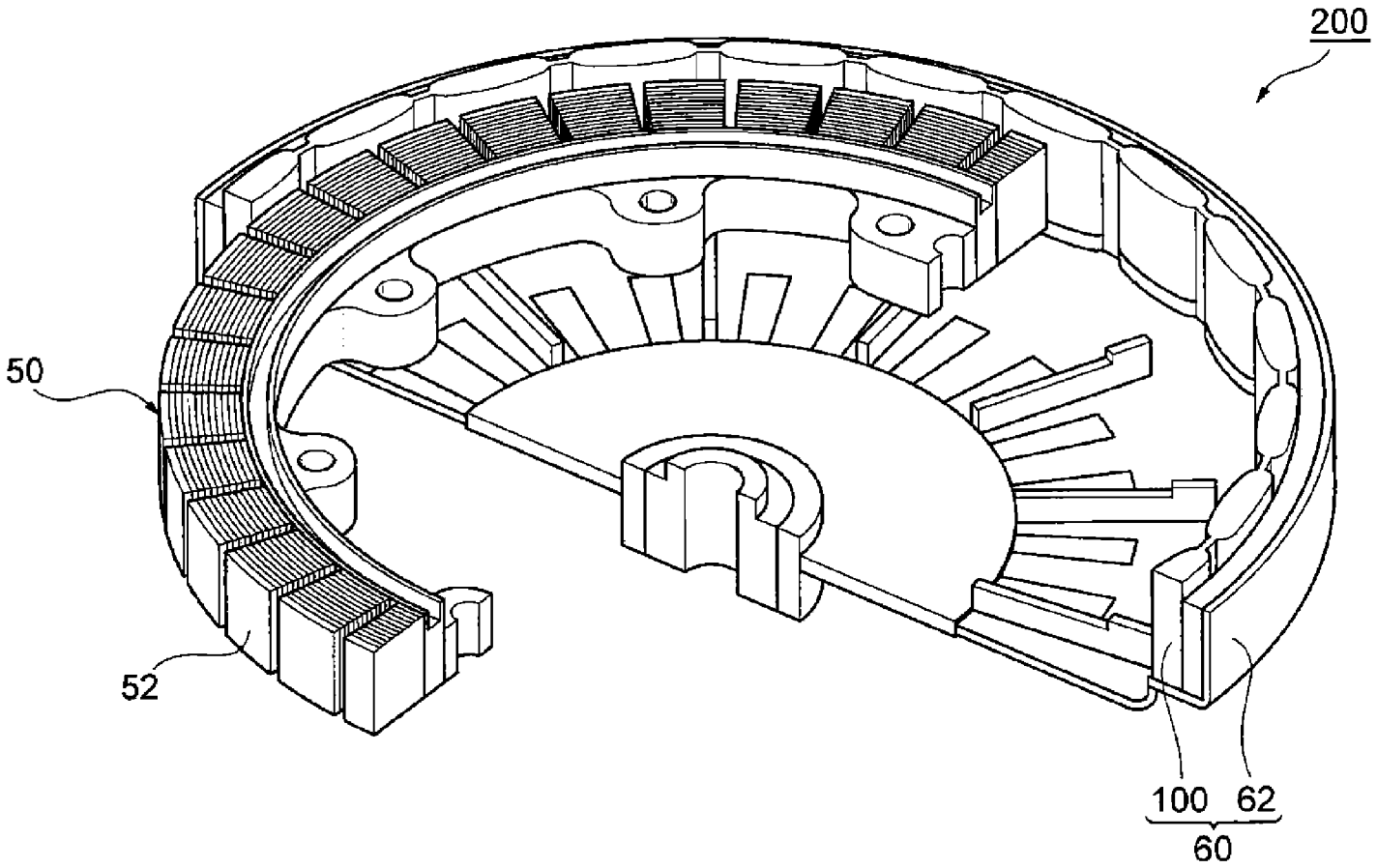
FIG. 9 is an illustration showing the internal structure of a motor comprising an R-T-B based sintered magnet according to an embodiment of the invention.

FIG. 9 is an illustration showing the internal structure of a motor comprising an R-T-B based sintered magnet 100 obtained by the production method described above. The motor 200 shown in FIG. 9 is a permanent magnet synchronous motor (SPM motor 200), comprising a cylindrical rotor 60 and a stator 50 situated on the inside of the rotor 60. The rotor 60 has a cylindrical core 62 and a plurality of R-T-B based sintered magnets 100 oriented with the N-poles and S-poles alternating along the inner peripheral surface of the cylindrical core 62. The stator 50 has a plurality of coils 52 provided along the outer peripheral surface. The coils 52 and R-T-B based sintered magnets 100 are arranged in a mutually opposing fashion.

The SPM motor 200 is provided with an R-T-B based sintered magnet 100 in the rotor 60. The R-T-B based sintered magnet 100 exhibits high levels in terms of both high magnetic properties and excellent corrosion resistance. Thus, the SPM motor 200 comprising the R-T-B based sintered magnet 100 can continuously exhibit high output for prolonged periods.

The embodiment described above is only a preferred embodiment of the invention, and the invention is in no way limited thereto. For example, the R-T-B based alloy strip of this embodiment had the crystal nuclei 42 of the $R_2T_{14}B$ phase only on one side, but it may also have the crystal nuclei 42 on the opposite side (on both sides) of the R-T-B based alloy strip. In this case, both sides preferably have the structure shown in FIG. 1. Thus, an R-T-B based alloy strip having dendritic crystals 40 as shown in FIG. 1 on both sides can be obtained by a twin-roll casting method in which two cooling rolls having the aforementioned concavoconvex pattern are aligned and molten alloy is cast between them.

EXAMPLES

The nature of the invention will now be further explained through the following examples and comparative examples. However, the invention is not limited to the examples described below.

Example 1

Fabrication of Alloy Strip

An apparatus for production of an alloy strip as shown in FIG. 3 was used for a strip casting method by the following procedure. First, the starting compounds for each of the constituent elements were added so that the composition of the alloy strip had the elemental ratios (mass %) shown in Table 2, and heated to 1300° C. with a high-frequency melting furnace 10, to prepare a molten alloy 12 having an R-T-B based composition. The molten alloy 12 was poured onto the roll surface 17 of the cooling roll 16 rotating at a prescribed speed through a tundish. The cooling rate of the molten alloy 12 on the roll surface 17 was 1800° C. to 2200° C./sec.

The roll surface 17 of the cooling roll 16 had a concavoconvex pattern comprising straight linear first recesses 32 extending along the rotational direction of the cooling roll 16, and straight linear second recesses 34 perpendicular to the first recesses 32. The average value H for the heights of the raised sections 36, the average value W for the spacings between the raised sections 36, and the surface roughness Rz, were as shown in Table 1. Measurement of the surface roughness Rz was carried out using a measuring apparatus by Mitsutoyo Corp. (trade name: SURFTEST).

The alloy strip obtained by cooling with the cooling roll 16 was further cooled with a secondary cooling section 60 to obtain an alloy strip having an R-T-B based composition. The composition of the alloy strip was as shown in Table 2.

<Evaluation of Alloy Strip>

Figure 10:
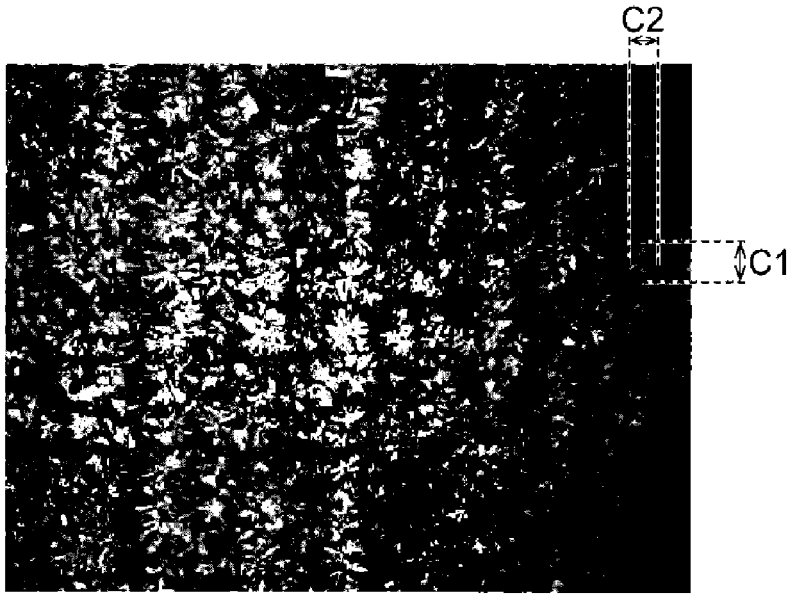
FIG. 10 is a metallographic microscope photograph (magnification: 100×) of one surface of the R-T-B based alloy strip of Example 1.

FIG. 10 is a metallographic microscope photograph (magnification: 100×) of the casting surface of the R-T-B based alloy strip of Example 1. The casting surface of the alloy strip was observed with a metallographic microscope, to determine the average value for the widths P of the dendritic crystals, the ratio of the lengths C2 of the short axes with respect to the lengths C1 of the long axes of the dendritic crystal groups (aspect ratio), the area occupancy of the $R_2T_{14}B$ phase crystals with respect to the total visual field, and the number of dendritic crystal nuclei generated per unit area (1 $mm^2$). The results are shown in Table 1. The area occupancy of the $R_2T_{14}B$ phase crystals is the area ratio of dendritic crystals with respect to the total image, in a metallographic microscope photograph of the casting surface of the R-T-B based alloy strip. In FIG. 10, the dendritic crystals correspond to the white sections. The average value for the aspect ratio of the crystal group of the dendritic crystals is the arithmetic mean value for the ratio (C2/C1) for 100 arbitrarily selected crystal groups.

Next, the R-T-B based alloy strip was cut along the thickness direction and the cut surface was observed by SEM-BEI (magnification: 300×). The thickness of the alloy strip was determined by the observed image. The thickness was as shown in Table 1.

<Fabrication of R-T-B Based Sintered Magnet>

The alloy strip was then ground with a jet mill to obtain alloy powder with a mean particle diameter of 2.0 μm. The alloy powder was packed into a die situated in an electromagnet, and molded in a magnetic field to produce a compact. The molding was accomplished by pressing at 1.2 t/$cm^2$ while applying a magnetic field of 15 kOe. The compact was then fired at 930° C. to 1030° C. for 4 hours in a vacuum and rapidly cooled to obtain a sintered compact. The obtained sintered compact was subjected to two-stage aging treatment at 800° C. for 1 hour and at 540° C. for 1 hour (both in an argon gas atmosphere), to obtain an R-T-B based sintered magnet for Example 1.

<Evaluation of R-T-B Based Sintered Magnet>

A B—H tracer was used to measure the Br (residual flux density) and HcJ (coercive force) of the obtained R-T-B based sintered magnet. The measurement results are shown in Table 1.

Examples 2 to 6, Examples 16 to 19

Figure 11:
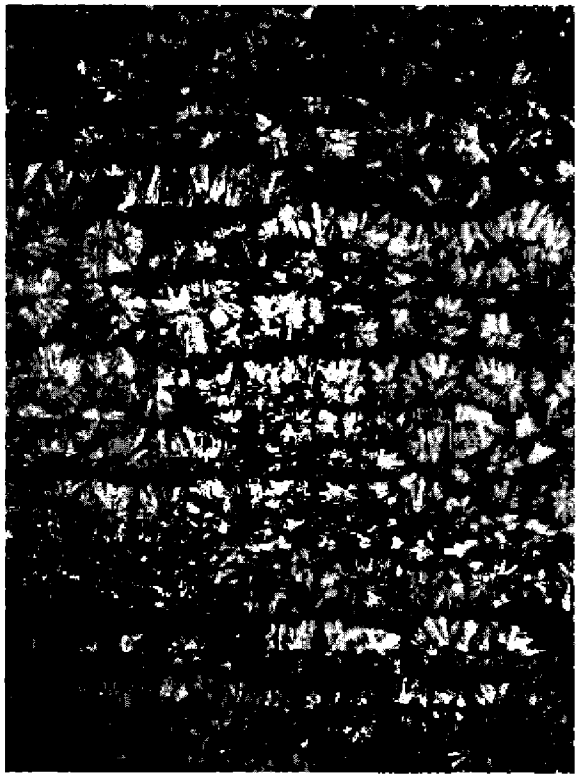
FIG. 11 is a metallographic microscope photograph (magnification: 100×) of one surface of the R-T-B based alloy strip of Example 2.

Alloy strips for Examples 2 to 6 and Examples 16 to 19 were obtained in the same manner as Example 1, except that the roll surface of a cooling roll was worked to change the average value H for the heights of the raised sections, the average value W for the spacings between the raised sections and the surface roughness Rz, as shown in Table 1. The alloy strips of Examples 2 to 6 and Examples 16 to 19 were also evaluated in the same manner as Example 1. FIG. 11 is a metallographic microscope photograph (magnification: 100×) of the casting surface of the R-T-B based alloy strip of Example 2. R-T-B based sintered magnets for Comparative Examples 2 to 6 were fabricated in the same manner as Example 1 and evaluated. The results are shown in Table 1.

Examples 7 to 15 and Examples 20 to 32

Alloy strips for Examples 7 to 15 and Examples 20 to 32 were obtained in the same manner as Example 1, except that the roll surface of a cooling roll was worked to change the average value for the heights of the raised sections, the average value for the spacings between the raised sections and the surface roughness Rz, as shown in Table 1, and the starting materials were changed to change the compositions of the alloy strip as shown in Table 2. The alloy strips of Examples 7 to 15 and Examples 20 to 32 were also evaluated in the same manner as Example 1. Also, R-T-B based sintered magnets for Examples 7 to 15 and Examples 20 to 32 were fabricated in the same manner as Example 1, and evaluated. The results are shown in Table 1.

Comparative Example 1

An alloy strip for Comparative Example 1 was obtained in the same manner as Example 1, except that there was used a cooling roll having on the roll surface only straight linear first recesses extending in the rotational direction of the roll. The cooling roll did not have second recesses. The average value H for the heights of the raised sections, the average value W for the spacings between the raised sections and the surface roughness Rz, for the cooling roll, were determined in the following manner. Specifically, the cross-sectional structure near the roll surface was observed at the cut surface, when the cooling roll was cut on a plane parallel to the axial direction running through the axis of the cooling roll. The average value H for the heights of the raised sections is the arithmetic mean value for the heights of 100 raised sections, and the average value W for the spacings between the raised sections is the arithmetic mean value for the values of spacings between adjacent raised sections measured at 100 different locations.

Figure 12:
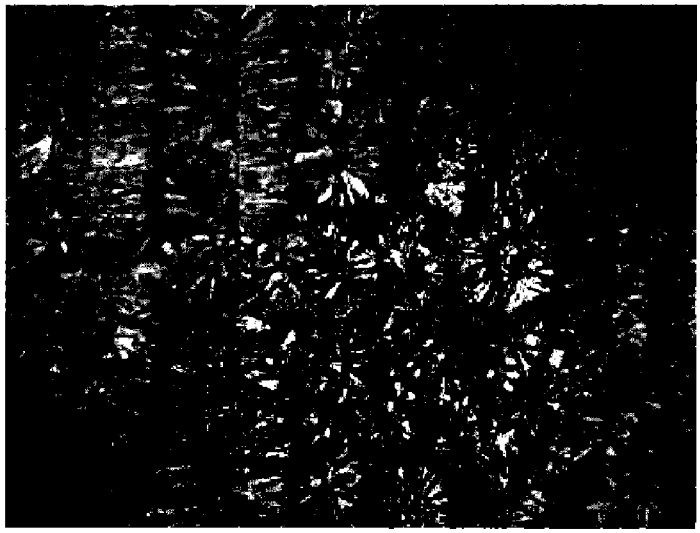
FIG. 12 is a metallographic microscope photograph (magnification: 100×) of one surface of the R-T-B based alloy strip of Comparative Example 1.

FIG. 12 is a metallographic microscope photograph (magnification: 100×) of the casting surface of the R-T-B based alloy strip of Comparative Example 1. The alloy strip of Comparative Example 1 was evaluated in the same manner as Example 1. An R-T-B based sintered magnet for Comparative Example 1 was fabricated in the same manner as Example 1 and evaluated. The results are shown in Table 1.

Comparative Examples 2 and 3

Figure 13:
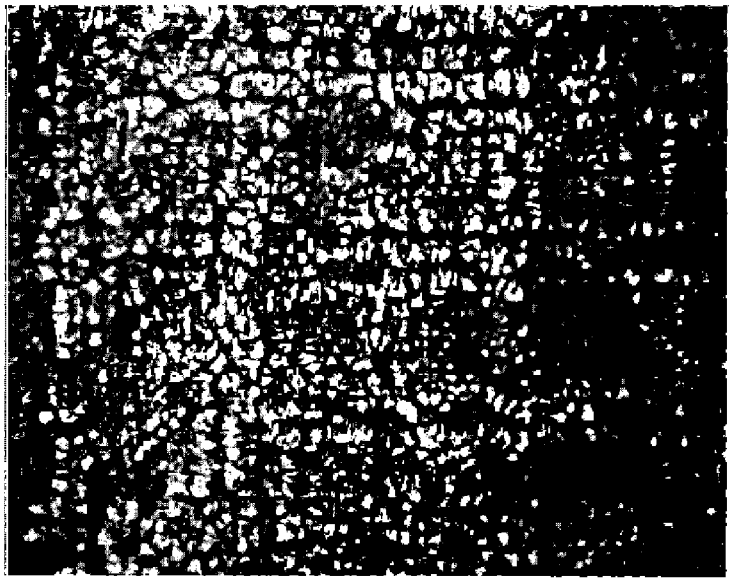
FIG. 13 is a metallographic microscope photograph (magnification: 100×) of one surface of the R-T-B based alloy strip of Comparative Example 2.
Figure 14:
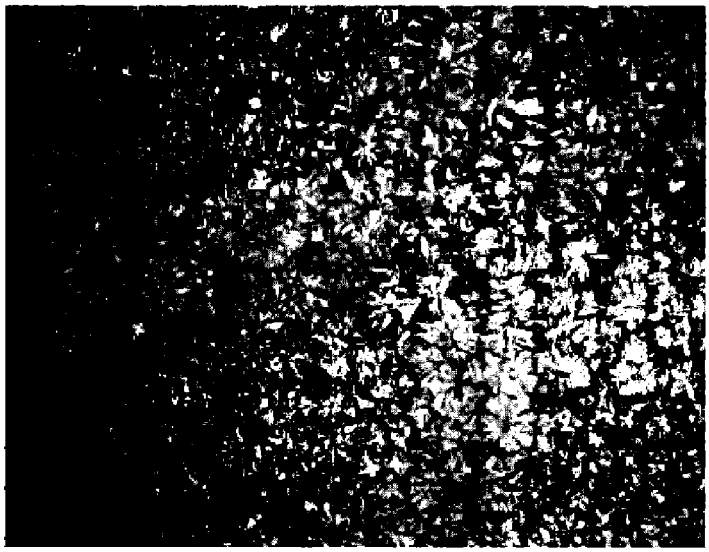
FIG. 14 is a metallographic microscope photograph (magnification: 100×) of one surface of the R-T-B based alloy strip of Comparative Example 3.

R-T-B based alloy strips for Comparative Examples 2 and 3 were obtained in the same manner as Example 1, except that the roll surface of a cooling roll was worked to change the average value H for the heights of the raised sections, the average value W for the spacings between the raised sections and surface roughness Rz, as shown in Table 1. The R-T-B based alloy strips of Comparative Examples 2 and 3 were also evaluated in the same manner as Example 1. FIG. 13 is a metallographic microscope photograph (magnification: 100×) of the casting surface of the R-T-B based alloy strip of Comparative Example 2. FIG. 14 is a metallographic microscope photograph (magnification: 100×) of the casting surface of the R-T-B based alloy strip of Comparative Example 3. R-T-B based sintered magnets for Comparative Examples 2 and 3 were fabricated in the same manner as Example 1 and evaluated. The results are shown in Table 1.

Comparative Example 4

An R-T-B based alloy strip was obtained for Comparative Example 4 in the same manner as Example 1, except that there were used cooling rolls having only straight linear first recesses on the roll surfaces extending in the rotational direction of the rolls, and the starting materials were changed to change the composition of the alloy strip as shown in Table 2. These cooling rolls did not have second recesses. The average value H for the heights of the raised sections, the average value W for the spacings between the raised sections and the surface roughness Rz, for the cooling rolls, were determined in the same manner as Comparative Example 1.

The alloy strip of Comparative Example 4 was evaluated in the same manner as Example 1. An R-T-B based sintered magnet for Comparative Example 4 was fabricated in the same manner as Example 1 and evaluated. The results are shown in Table 1.

TABLE 1

| | Cold roll surface | | | | | R—T—B based alloy scrip surface | | | | Magnetic properties | |
|---|---|---|---|---|---|---|---|---|---|---|---|
| | Concavoconvex pattern | Surface roughness (Rz) μm | Raised section height (mean value H) μm | Raised section spacing (mean value W) μm | Alloy strip Thickness mm | Crystal width P (mean value) μm | Number of generated crystal nuclei (/mm$^2$) | Crystal group aspect ratio (mean value) | Area occupancy (%) | Br (kG) | Hcj (kOe) |
| Example 1 | perpendicular | 4.2 | 7.0 | 66 | 0.30 | 48 | 763 | 0.88 | 93 | 14.0 | 16.4 |
| Example 2 | perpendicular | 4.5 | 9.0 | 64 | 0.29 | 47 | 820 | 0.90 | 95 | 14.1 | 16.7 |
| Example 3 | perpendicular | 3.9 | 11.6 | 60 | 0.27 | 42 | 948 | 0.91 | 93 | 13.9 | 17.5 |
| Example 4 | perpendicular | 4.1 | 11.6 | 57 | 0.25 | 42 | 1028 | 0.94 | 94 | 13.9 | 18.1 |
| Example 5 | perpendicular | 4.4 | 13.0 | 54 | 0.23 | 42 | 903 | 0.90 | 90 | 13.8 | 18.8 |
| Example 6 | perpendicular | 4.5 | 14.0 | 48 | 0.18 | 38 | 1028 | 0.97 | 85 | 13.7 | 16.7 |
| Example 7 | perpendicular | 4.3 | 8.5 | 65 | 0.23 | 44 | 949 | 0.90 | 95 | 13.8 | 17.5 |
| Example 8 | perpendicular | 4.2 | 8.7 | 63 | 0.23 | 42 | 1008 | 0.90 | 94 | 13.0 | 19.8 |
| Example 9 | perpendicular | 4.4 | 9.2 | 67 | 0.23 | 45 | 1023 | 0.90 | 95 | 12.6 | 20.6 |
| Example 10 | perpendicular | 4.4 | 10.2 | 62 | 0.26 | 44 | 843 | 0.94 | 93 | 13.9 | 16.5 |
| Example 11 | perpendicular | 4.5 | 10.6 | 64 | 0.24 | 45 | 865 | 0.93 | 93 | 14.0 | 16.7 |
| Example 12 | perpendicular | 4.3 | 10.4 | 58 | 0.25 | 40 | 902 | 0.95 | 95 | 14.1 | 16.4 |
| Example 13 | perpendicular | 4.3 | 9.9 | 57 | 0.23 | 41 | 920 | 0.93 | 94 | 14.0 | 16.3 |
| Example 14 | perpendicular | 4.4 | 9.8 | 65 | 0.27 | 46 | 810 | 0.89 | 91 | 14.4 | 14.8 |
| Example 15 | perpendicular | 4.4 | 10.7 | 57 | 0.23 | 42 | 908 | 0.93 | 94 | 13.2 | 18.2 |
| Example 16 | perpendicular | 3.7 | 5.2 | 82 | 0.21 | 60 | 500 | 0.90 | 82 | 14.4 | 15.0 |
| Example 17 | perpendicular | 3.4 | 5.5 | 74 | 0.23 | 52 | 600 | 0.92 | 83 | 14.4 | 15.4 |
| Example 18 | perpendicular | 4.9 | 13.1 | 47 | 0.34 | 25 | 945 | 0.90 | 84 | 14.2 | 15.9 |
| Example 19 | perpendicular | 4.8 | 12.6 | 55 | 0.31 | 32 | 938 | 0.92 | 85 | 14.3 | 16.4 |
| Example 20 | perpendicular | 4.2 | 6.8 | 65 | 0.31 | 45 | 808 | 0.90 | 89 | 14.0 | 16.6 |
| Example 21 | perpendicular | 4.2 | 7.0 | 68 | 0.30 | 48 | 775 | 0.88 | 88 | 14.0 | 17.1 |
| Example 22 | perpendicular | 4.3 | 6.9 | 66 | 0.29 | 48 | 782 | 0.91 | 93 | 13.9 | 19.1 |
| Example 23 | perpendicular | 4.2 | 7.0 | 67 | 0.31 | 53 | 735 | 0.88 | 92 | 13.9 | 18.7 |
| Example 24 | perpendicular | 4.1 | 7.1 | 64 | 0.30 | 48 | 752 | 0.88 | 87 | 14.4 | 15.1 |
| Example 25 | perpendicular | 4.2 | 7.0 | 65 | 0.30 | 50 | 747 | 0.90 | 90 | 14.4 | 18.3 |
| Example 26 | perpendicular | 4.2 | 7.2 | 66 | 0.30 | 52 | 739 | 0.91 | 90 | 14.5 | 17.1 |
| Example 27 | perpendicular | 4.3 | 6.9 | 66 | 0.31 | 46 | 808 | 0.88 | 91 | 14.4 | 18.0 |
| Example 28 | perpendicular | 4.2 | 7.1 | 67 | 0.28 | 45 | 803 | 0.90 | 90 | 13.5 | 17.9 |
| Example 29 | perpendicular | 4.2 | 6.8 | 65 | 0.30 | 52 | 759 | 0.86 | 85 | 14.6 | 15.5 |
| Example 30 | perpendicular | 4.2 | 7.2 | 68 | 0.30 | 50 | 750 | 0.87 | 85 | 14.6 | 15.6 |
| Example 31 | perpendicular | 4.1 | 7.0 | 66 | 0.32 | 58 | 694 | 0.86 | 83 | 14.6 | 15.1 |
| Example 32 | perpendicular | 4.2 | 7.1 | 67 | 0.29 | 53 | 698 | 0.88 | 83 | 14.7 | 14.4 |
| Camp. Ex. 1 | rotating direction | 2.9 | 5.8 | 126 | 0.29 | 110 | 685 | 0.68 | 80 | 13.8 | 13.8 |
| Comp. Ex. 2 | perpendicular | 5.8 | 16.9 | 35 | 0.31 | 20 | 435 | 0.93 | 31 | 13.6 | 12.5 |
| Como. Ex. 3 | perpendicular | 3.2 | 6.7 | 70 | 0.19 | 62 | 768 | 0.94 | 93 | 13.8 | 14.0 |
| Comp. Ex. 4 | rotating direction | 2.8 | 5.3 | 132 | 0.33 | 124 | 585 | 0.65 | 76 | 13.8 | 12.5 |

TABLE 2

| | Content based on mass of elements in R—T—B based alloy strip (mass %) | | | | | | | | | | |
|---|---|---|---|---|---|---|---|---|---|---|---|
| | Nd | Pr | Dy | Tb | Co | Cu | Al | Ga | Zr | B | Fe |
| Examples 1-6, Examples 16-19, Comp. Exs. 1-3 | 31.00 | 0.00 | 0.00 | 0.00 | 1.00 | 0.10 | 0.20 | 0.00 | 0.20 | 0.98 | 66.52 |
| Example 7 | 32.50 | 0.00 | 0.00 | 0.00 | 1.00 | 0.10 | 0.20 | 0.00 | 0.20 | 0.98 | 65.02 |
| Example 8 | 34.00 | 0.00 | 0.00 | 0.00 | 1.00 | 0.10 | 0.20 | 0.00 | 0.20 | 0.98 | 63.52 |
| Example 9 | 34.70 | 0.00 | 0,00 | 0.00 | 1.00 | 0.10 | 0.20 | 0.00 | 0.20 | 0.98 | 62.82 |
| Example 10 | 25.00 | 6.00 | 0.00 | 0.00 | 0.50 | 0.10 | 0.20 | 0.10 | 0.20 | 1.00 | 66.90 |
| Example 11 | 31.10 | 0.00 | 0.10 | 0.00 | 1.00 | 0.10 | 0.20 | 0.10 | 0.10 | 1.02 | 66.28 |
| Example 12 | 28.10 | 3.10 | 0.00 | 0.00 | 1.10 | 0.10 | 0.20 | 0.10 | 0.10 | 0.98 | 66.22 |
| Example 13 | 22.40 | 8.90 | 0.00 | 0.00 | 1.00 | 0.10 | 0.20 | 0.00 | 0.10 | 0.99 | 66.31 |
| Example 14 | 24.10 | 6.30 | 0.00 | 0.00 | 0.50 | 0.10 | 0.30 | 0.00 | 0.20 | 0.98 | 67.52 |
| Example 15 | 28.30 | 5.80 | 0.00 | 0.00 | 0.50 | 0.20 | 0.10 | 0.30 | 0.20 | 1.03 | 63.57 |

TABLE 2-continued

| | Content based on mass of elements in R—T—B based alloy strip (mass %) | | | | | | | | | | |
|---|---|---|---|---|---|---|---|---|---|---|---|
| | Nd | Pr | Dy | Tb | Co | Cu | Al | Ga | Zr | B | Fe |
| Example 20 | 31.10 | 0.00 | 0.10 | 0.00 | 1.00 | 0.10 | 0.20 | 0.10 | 0.10 | 1.02 | 66.28 |
| Example 21 | 30.00 | 0.00 | 1.00 | 0.00 | 1.00 | 0.10 | 0.20 | 0.00 | 0.20 | 1.00 | 66.50 |
| Example 22 | 30.90 | 0.00 | 0.30 | 0.00 | 1.00 | 0.10 | 0.20 | 0.10 | 0.10 | 1.02 | 66.28 |
| Example 23 | 22.40 | 8.40 | 0.50 | 0.00 | 1.00 | 0.10 | 0.20 | 0.00 | 0.10 | 0.99 | 66.31 |
| Example 24 | 24.00 | 6.30 | 0.00 | 0.10 | 0.50 | 0.10 | 0.30 | 0.00 | 0.20 | 0.98 | 67.52 |
| Example 25 | 28.70 | 0.00 | 0.80 | 0.00 | 0.50 | 0.08 | 0.20 | 0.00 | 0.20 | 0.88 | 68.64 |
| Example 26 | 29.10 | 0.00 | 0.40 | 0.00 | 0.50 | 0.03 | 0.20 | 0.00 | 0.20 | 0.90 | 68.67 |
| Example 27 | 28.80 | 0.00 | 0.70 | 0.00 | 0.50 | 0.08 | 0.20 | 0.00 | 0.25 | 0.90 | 68.57 |
| Example 28 | 34.00 | 0.00 | 0.00 | 0.00 | 1.00 | 0.10 | 0.20 | 0.00 | 0.20 | 1.03 | 63.47 |
| Example 29 | 29.50 | 0.00 | 0.00 | 0.00 | 0.50 | 0.10 | 0.20 | 0.00 | 0.06 | 0.90 | 68.74 |
| Example 30 | 29.50 | 0.00 | 0.00 | 0.00 | 0.50 | 0.20 | 0.20 | 0.00 | 0.20 | 0.91 | 68.49 |
| Example 31 | 28.30 | 0.00 | 0.00 | 0.00 | 1.00 | 0.10 | 0.20 | 0.00 | 0.20 | 1.10 | 69.10 |
| Example 32 | 28.30 | 0.00 | 0.00 | 0.00 | 2.80 | 0.10 | 0.20 | 0.00 | 0.20 | 1.00 | 67.40 |
| Comp. Ex. 4 | 25.00 | 6.00 | 0.00 | 0.00 | 0.50 | 0.10 | 0.20 | 0.10 | 0.20 | 1.00 | 66.90 |

Units of values in the table are mass %.
Values for Fe include unavoidable impurities.

The results shown in Table 1 confirmed that the R-T-B based sintered magnets of Examples 1 to 32 have excellent coercive force.

[Structural Analysis of R-T-B Based Sintered Magnets]

(Area and Standard Deviation for Triple Point Regions)

Figure 17:
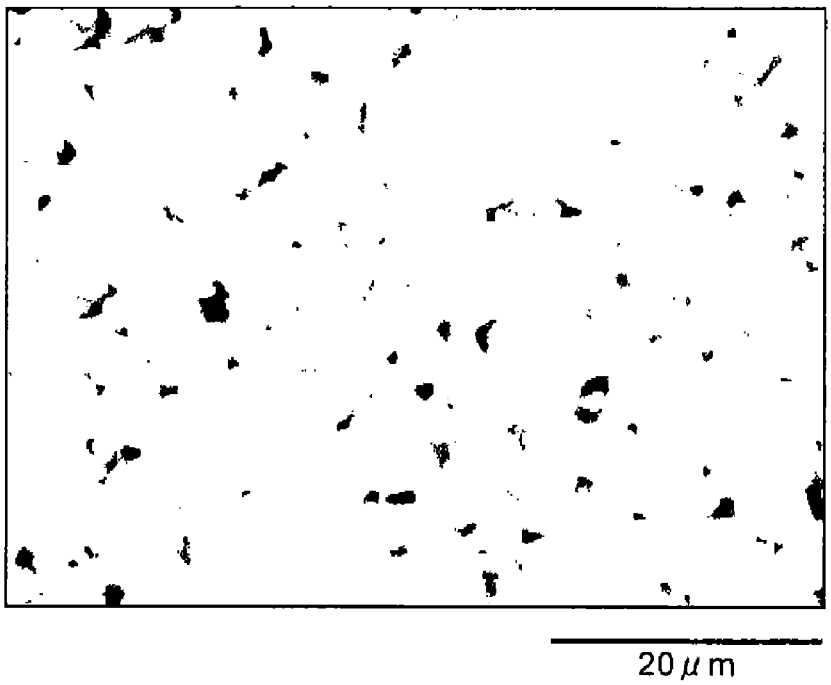
FIG. 17 is a diagram showing element map data for the rare earth sintered magnet of Example 10, with the triple point regions indicated in black.

For the R-T-B based sintered magnet of Example 10 there was used an electron beam microanalyzer (EPMA: JXA8500F Model FE-EPMA), and element map data were collected. The measuring conditions were: an acceleration voltage of 15 kV, an irradiation current of 0.1 μA and a count-time: of 30 msec, the data acquisition region was X=Y=51.2 μm, and the number of data points was X=Y=256 (0.2 μm-step). In the element map data, first triple point regions surrounded by 3 or more crystal grains are colored black, and by image analysis thereof, the average value for the area of the triple point regions and the standard deviation for the area distribution were calculated. FIG. 17 is a diagram showing element map data for the rare earth sintered magnet of Example 10, with the triple point regions indicated in black.

Figure 18:
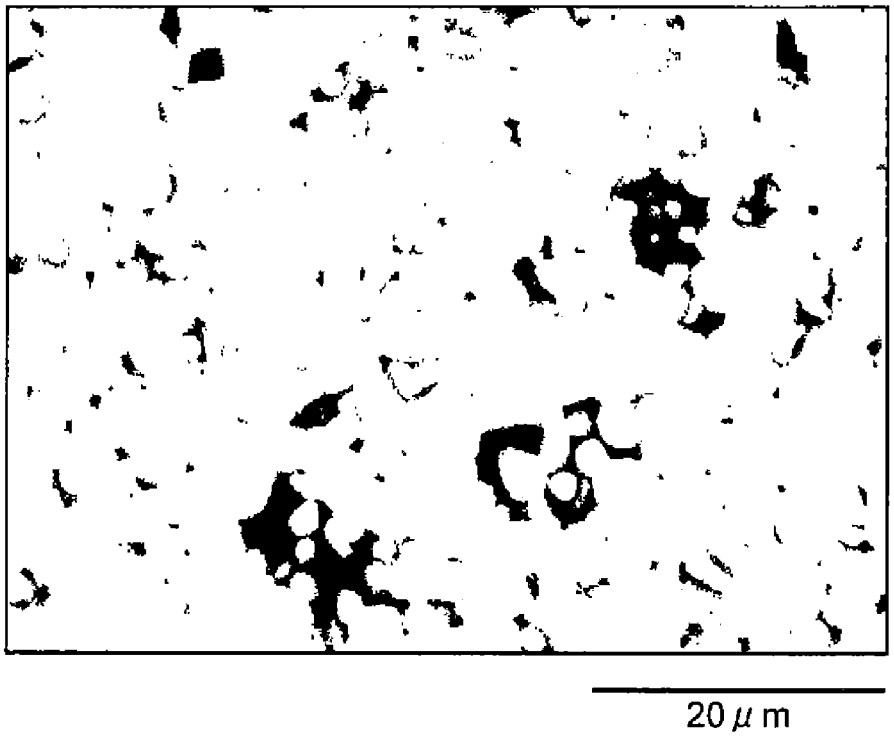
FIG. 18 is a diagram showing element map data for the R-T-B based sintered magnet of Comparative Example 4, with the triple point regions indicated in black.

The EPMA was used for structural observation of the R-T-B based sintered magnets of Examples 10 to 15 and Comparative Example 4 in the same manner as the R-T-B based sintered magnet of Example 10. FIG. 18 is a diagram showing element map data for the R-T-B based sintered magnet of Comparative Example 4, with the triple point regions indicated in black.

Image analysis was performed for Examples 10 to 15 and Comparative Example 4 in the same manner as Example 10, and the average value for the area of the triple point regions and the standard deviation for the area distribution were calculated. The results are shown in Table 3. As shown in Table 3, the R-T-B based sintered magnets of Examples 10 to 15 had sufficiently smaller values for the average value and standard deviation for the area of the triple point regions, compared to Comparative Example 4. These results confirmed that in Examples 10 to 15, segregation of the phase with a higher R content than the $R_2T_{14}B$ phase was inhibited.

(Mean Particle Diameter)

In addition, using a similar electron microscope observation image, the shapes of the $R_2T_{14}B$ phase crystal grains were discerned by image analysis, the diameters of each of the individual crystal grains were determined, and the arithmetic mean value was obtained. This was recorded as the mean particle diameter of the $R_2T_{14}B$ phase crystal grains. The results are shown in Table 3.

(Rare Earth Element Content of Triple Point Regions)

EPMA was used to determine the rare earth element content of the triple point regions of the R-T-B based sintered magnets of Examples 10 to 15 and Comparative Example 4, based on mass. The measurement was conducted for 10 triple point regions, and the range and standard deviation for the rare earth element content was determined. The results are shown in Table 3.

(Oxygen, Nitrogen and Carbon Contents)

A common gas analysis apparatus was used for gas analysis of the R-T-B based sintered magnets of Examples 10 to 15 and Comparative Example 4, and the oxygen, nitrogen and carbon contents were determined. The results are shown in Table 3.

TABLE 3

| | Mean particle diameter (μm) | Triple point region area: Mean value ($\mu m^2$) | Triple point region area: S.D. | Rare earth elements of triple point regions: Content (mass %) | Rare earth elements of triple point regions: S.D. | Oxygen content (ppm) | Nitrogen content (ppm) | Carbon content (ppm) |
|---|---|---|---|---|---|---|---|---|
| Example 10 | 3.32 | 1.2 | 1.1 | 92-98 | 2.4 | 590 | 560 | 1100 |
| Example 11 | 3.25 | 1.8 | 2.6 | 91-98 | 2.7 | 890 | 820 | 950 |
| Example 12 | 3.43 | 1.5 | 2.3 | 92-98 | 2.5 | 780 | 780 | 1020 |
| Example 13 | 3.22 | 1.7 | 2.1 | 91-98 | 2.8 | 650 | 870 | 980 |
| Example 14 | 4.31 | 1.3 | 1.5 | 92-98 | 2.1 | 530 | 680 | 1440 |
| Example 15 | 3.86 | 1.9 | 1.7 | 93-98 | 2.6 | 1420 | 1010 | 1380 |
| Comp. Ex. 4 | 3.65 | 3.4 | 7.1 | 82-98 | 5.7 | 800 | 760 | 1380 |

A shown in Tables 1 and 3, although Example 10 and Comparative Example 4 both used alloy powder having about the same mean particle diameter, the R-T-B sintered magnet obtained in Example 10 had higher coercive force. This is presumably because the R-T-B based sintered magnet of Example 10 not only had a finer crystal grain particle diameter, but also had more uniform particle diameters and shapes of the crystal grains, and therefore reduced segregation of the triple point regions.

INDUSTRIAL APPLICABILITY

According to the invention it is possible to provide an alloy strip that can increase the coercive force of an R-T-B based sintered magnet. It is also possible to provide an R-T-B based sintered magnet having sufficiently excellent coercive force, as well as a method for producing it.

EXPLANATION OF SYMBOLS

10: High-frequency melting furnace, 12: molten alloy, 14: tundish, 16: cooling roll, 17: roll surface, 18: alloy strip, 19: gas tube, 19*a*: gas blow hole, 20: secondary collector, 32, 34: recesses, 36: raised section, 40: dendritic crystal, 42: crystal nuclei, 44: filler-like crystals, 50: stator, 52: coil, 60: rotor, 62: core, 100: R-T-B based sintered magnet, 120: crystal grain, 140: triple point region (grain boundary region), 200: motor.

The invention claimed is:

1. An R-T-B based alloy strip comprising dendritic crystals including a $R_2T_{14}B$ phase, wherein R represents at least one element selected from the group consisting of rare earth elements, T represents at least one of iron and cobalt, and B represents boron, wherein on a casting surface of the R-T-B based alloy strip, the dendritic crystal has a crystal nucleus and filler-shaped crystals extending in a radial fashion with the crystal nucleus as the origin, each of the widths of the dendritic crystals is determined as the maximum distance among the distances between tips of two different filler-shaped crystals, the average value for the widths of the dendritic crystals is no greater than 60 μm, and the number of crystal nuclei in the dendritic crystals is at least 500 per 1 mm square area.

2. The R-T-B based alloy strip according to claim 1, wherein the average value for the widths of the dendritic crystals is 25 μm or greater.

3. The R-T-B based alloy strip according to claim 1, wherein the average value for the aspect ratio of crystal groups comprising a plurality of the dendritic crystals is 0.8 or greater.

4. An R-T-B based sintered magnet obtained by molding and firing alloy powder obtained by grinding an R-T-B based alloy strip according to claim 1.

5. A method for producing an R-T-B based sintered magnet, comprising the steps of:

grinding an R-T-B based alloy strip according to claim 1 to prepare an alloy powder, and molding and firing the alloy powder to produce the R-T-B based sintered magnet.

* * * * *